US009543129B2

(12) United States Patent
Suzuki et al.

(10) Patent No.: US 9,543,129 B2
(45) Date of Patent: Jan. 10, 2017

(54) ELECTRON MULTIPLIER

(75) Inventors: Akio Suzuki, Hamamatsu (JP); Yuto Yanagihara, Hamamatsu (JP); Hiroshi Kobayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/123,250

(22) PCT Filed: May 31, 2012

(86) PCT No.: PCT/JP2012/064195
§ 371 (c)(1),
(2), (4) Date: Feb. 4, 2014

(87) PCT Pub. No.: WO2012/165589
PCT Pub. Date: Dec. 6, 2012

(65) Prior Publication Data

US 2014/0152168 A1 Jun. 5, 2014

(30) Foreign Application Priority Data

Jun. 2, 2011 (JP) ..... P2011-124561

(51) Int. Cl.
*H01J 25/76* (2006.01)
*H01J 43/04* (2006.01)
(Continued)

(52) U.S. Cl.
CPC ..... *H01J 43/04* (2013.01); *H01J 43/246* (2013.01); *H01J 43/28* (2013.01)

(58) Field of Classification Search
CPC ..... H01J 43/246; H01J 43/28
(Continued)

(56) References Cited

U.S. PATENT DOCUMENTS 3,868,536 A * 2/1975 Enck, Jr. ..... 315/12.1
4,948,965 A * 8/1990 Feller ..... 250/207
(Continued)

FOREIGN PATENT DOCUMENTS

CN 1182279 5/1998
JP 6-28997 A 2/1994
(Continued)

*Primary Examiner* — Nimeshkumar Patel
*Assistant Examiner* — Christopher Raabe
(74) *Attorney, Agent, or Firm* — Drinker Biddle & Reath LLP

(57) ABSTRACT

An electron multiplier includes an insulating substrate which includes an electrical wiring pattern and in which a through-hole is formed, an MCP arranged on one side of the through-hole of the insulating substrate and electrically connected to the electrical wiring pattern, a shield plate arranged in one side of the MCP and electrically connected to the MCP, an anode arranged on the other side of the through-hole and electrically connected to the electrical wiring pattern, and a signal readout terminal fixed to the insulating substrate for reading a signal from the anode. The shield plate is formed to include the MCP when viewed in a thickness direction. A through-hole exposing at least a portion of the MCP is formed in the shield plate. The insulating substrate, the MCP, the shield plate and the anode are fixed to each other to be integral.

13 Claims, 24 Drawing Sheets

(51) Int. Cl.
*H01J 43/24* (2006.01)
*H01J 43/28* (2006.01)

(58) Field of Classification Search
USPC ..... 313/103 R
See application file for complete search history.

(56) References Cited

U.S. PATENT DOCUMENTS

| | | | | |
|---|---|---|---|---|
| 5,132,586 | A * | 7/1992 | Boulais et al. | 313/105 CM |
| 5,159,231 | A * | 10/1992 | Feller et al. | 313/103 CM |
| 5,568,013 | A | 10/1996 | Then et al. | |
| 6,265,812 | B1 * | 7/2001 | Watanabe et al. | 313/103 CM |
| 7,564,043 | B2 * | 7/2009 | Hayashi et al. | 250/397 |
| 2003/0127582 | A1 * | 7/2003 | Jones | 250/207 |
| 2004/0191940 | A1 | 9/2004 | Saldana et al. | |
| 2005/0145788 | A1 * | 7/2005 | Davis et al. | 250/288 |
| 2009/0236517 | A1 * | 9/2009 | Suzuki et al. | 250/287 |
| 2010/0243887 | A1 * | 9/2010 | Suyama et al. | 250/287 |
| 2011/0002109 | A1 | 1/2011 | Hauschild et al. | |

FOREIGN PATENT DOCUMENTS

| | | | |
|---|---|---|---|
| JP | H08-179045 | A | 7/1996 |
| JP | 2003-509812 | A | 3/2003 |
| JP | 3561018 | | 9/2004 |
| JP | 2005-216742 | A | 8/2005 |
| JP | 2006-522454 | A | 9/2006 |
| JP | 2007-087855 | | 4/2007 |
| JP | 2007-087885 | A | 4/2007 |
| JP | 2010-238502 | A | 10/2010 |

* cited by examiner

ELECTRON MULTIPLIER

TECHNICAL FIELD

The present invention relates to an electron multiplier, and more particularly, to an electron multiplier including a micro-channel plate.

BACKGROUND ART

As a conventional electron multiplier, an electron multiplier including a micro-channel plate (hereinafter also referred to as an "MCP") formed by forming a number of fine through-holes (channels) in a thin plate-shaped glass substrate is known. In this electron multiplier, when the electrons are incident on a channel of the micro-channel plate to which a voltage has been applied, the electrons repeatedly collide with a sidewall in the channel and secondary electrons are emitted such that the electrons are multiplied, and the multiplied electrons are detected in an anode. As such an electron multiplier, an electron multiplier in which a dielectric insulator is film-deposited on a micro-channel plate is disclosed, for example, in Patent Literature 1.

CITATION LIST

Patent Literature

[Patent Literature 1] Japanese Patent Application No. 2006-522454

SUMMARY OF INVENTION

Technical Problem

Incidentally, in a recent electron multiplier, for example, with the increasing popularization of various analyzers, including mass spectrometry, a semiconductor inspection apparatus, and surface analysis, it is desired to reduce cost by reducing the number of parts. In addition, the electron multiplier as described above, it is desired to stabilize operation of the electron multiplier and increase reliability.

It is therefore an object of the present invention to provide an electron multiplier in which it is capable of reducing cost and increasing reliability.

Solution to Problem

In order to achieve the above object, an electron multiplier of an aspect of the present invention includes: an insulating substrate which includes an electrical wiring pattern and in which a through-hole extending in a thickness direction is formed; a micro-channel plate arranged on one side of a through-hole of the insulating substrate in the thickness direction and electrically connected to the electrical wiring pattern; a metal plate arranged in one side of the micro-channel plate in the thickness direction and electrically connected to the micro-channel plate; an anode arranged on the other side of a through-hole of the insulating substrate in the thickness direction and electrically connected to the electrical wiring pattern; and a signal readout terminal fixed to the insulating substrate for reading a signal from the anode through the electrical wiring pattern, wherein the metal plate is formed to include the micro-channel plate when viewed in the thickness direction, and a through-hole exposing at least a portion of the micro-channel plate is formed in the metal plate, and the insulating substrate, the micro-channel plate, the metal plate and the anode are fixed to each other to be integral.

In this electron multiplier, the wiring is provided in the insulating substrate as the electrical wiring pattern, the micro-channel plate and the anode are mounted on this insulating substrate, the micro-channel plate is shielded by the metal plate, and these are integrally configured. The following operational effects are achieved by such a configuration. In other words, it is possible to reduce the number of parts, simplify the configuration and reduce cost. It is also possible to suppress charge-up of the micro-channel plate using the electronic metal plate and stabilize the operation of the electron multiplier for high reliability.

Further, in the electrical wiring pattern, an output side of the micro-channel plate may be connected to a voltage supply terminal which is electrically connected to the other side of the micro-channel plate through a first bleeder circuit unit. In this case, a voltage supply terminal for an output-side electrode of the micro-channel plate is unnecessary and it is possible to reduce the number of wirings.

In this case, in the electrical wiring pattern, a second bleeder circuit unit having a smaller resistance value than resistance value of the micro-channel plate may be connected in parallel with the micro-channel plate. It is found that a characteristic of the micro-channel plate and thus a characteristic of the output signal from the anode is changed due to the micro-channel plate potential and the potential between the output side of the micro-channel plate and the anode. Therefore, when there is a variation in the resistance value of the micro-channel plate, these potentials are changed and accordingly the characteristic of the output signal is changed. In this regard, even when the resistance value of the micro-channel plate is changed, it is possible to suppress a change in the micro-channel plate potential and the potential between the micro-channel plate and the anode by attaching the second bleeder part as described above, and accordingly, to achieve stabilization of the output signal.

Further, a voltage to be supplied to one side of the micro-channel plate may be applied to the metal plate. In this case, for example, the electrode which supplies a potential to the input-side electrode of the micro-channel plate installed on the electrical wiring pattern is unnecessary and it is possible to reduce the number of wirings.

Further, the metal plate may be formed to include the insulating substrate when viewed in the thickness direction. In this case, it is possible to suppress charge-up of the insulating substrate using the metal plate and further stabilize the operation of the electron multiplier.

Further, specifically, the following configuration may be taken as a configuration for achieving the operational effects. In other words, the micro-channel plate may be interposed between the insulating substrate and the metal plate and fixed to the insulating substrate and the metal plate. Further, the metal plate is fixed to the insulating substrate by a conductive fastening member and electrically connected to the electrical wiring pattern. Further, the anode is fixed to the insulating substrate by a conductive bonding agent and electrically connected to the electrical wiring pattern.

Further, a fixing hole for fixation to the outside may be provided in at least one of the insulating substrate and the metal plate. In this case, it is possible to easily and suitably fix and hold the electron multiplier.

Further, the insulating substrate may be a refractive substrate which at least includes a first parallel portion extending in parallel with the metal plate, a second parallel portion arranged to be stacked on the other side of the first parallel portion in the thickness direction, and an intersecting portion which intersects the first and second parallel portions to connect the first and second parallel portions, the through-hole of the insulating substrate may be formed in the first parallel portion, the anode may be provided on a surface of the first parallel portion on the second parallel portion side, and a post having an insulating property or conductive property may be interposed between the first and second parallel portions. It is possible to reduce an exclusive area of the insulating substrate when viewed in the thickness direction in this case as well.

Further, the insulating substrate may at least include a first substrate, and a second substrate arranged to be stacked on the other side of the first substrate in the thickness direction, the through-hole of the insulating substrate may be formed in the first substrate, and the anode may be provided on a surface of the first substrate on the second substrate side, and a post having an insulating property or conductive property may be interposed between the first and second substrates. It is possible to reduce an exclusive area of the insulating substrate when viewed in the thickness direction in this case as well.

Further, the insulating substrate may be a multi-substrate which at least includes a first substrate, and a second substrate arranged to be stacked on the other side of the first substrate in the thickness direction, the through-hole of the insulating substrate may be formed in the first substrate, and the anode may be provided on the surface of the second substrate on the first substrate side. It is possible to reduce an exclusive area of the insulating substrate when viewed in the thickness direction in this case as well.

In this case, a noise shield portion may be formed on a surface of the second substrate on the side opposite to the first substrate. In this case, it is possible to reduce adverse effects of noise.

Advantageous Effects of Invention

According to the present invention, it is possible to reduce cost and increase reliability.

DESCRIPTION OF EMBODIMENTS

In the following, preferred embodiments of the present invention will be explained in detail with reference to the drawings. In the following description, the same or equivalent parts will be referred to with the same signs, while omitting their overlapping descriptions.

First Embodiment

Figure 1:
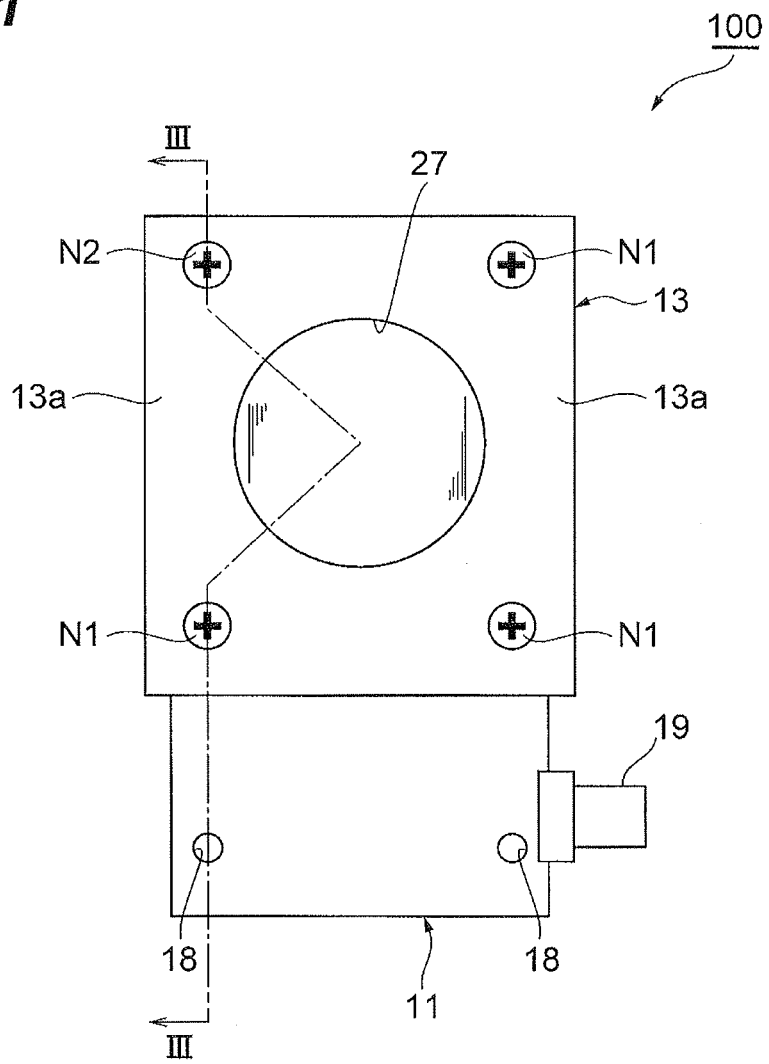
FIG. 1 is a schematic view illustrating an incidence surface side of an electron multiplier according to a first embodiment.
Figure 2:
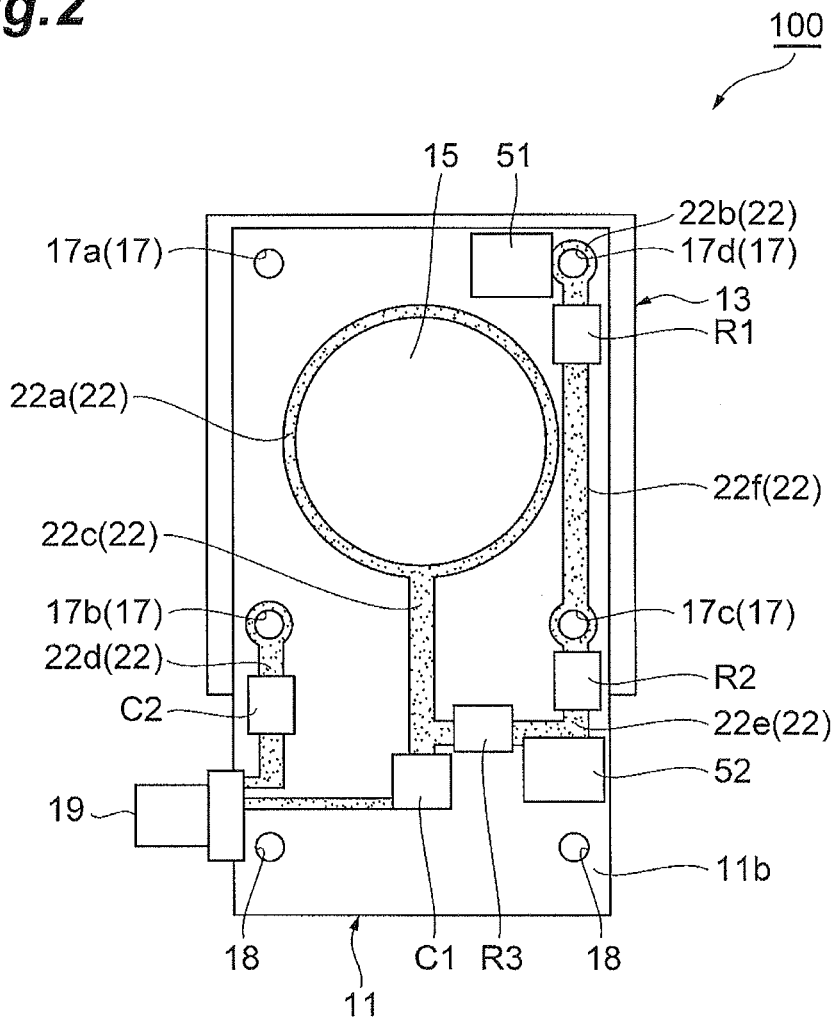
FIG. 2 is a schematic view illustrating an anode side of the electron multiplier of FIG. 1.
Figure 3:
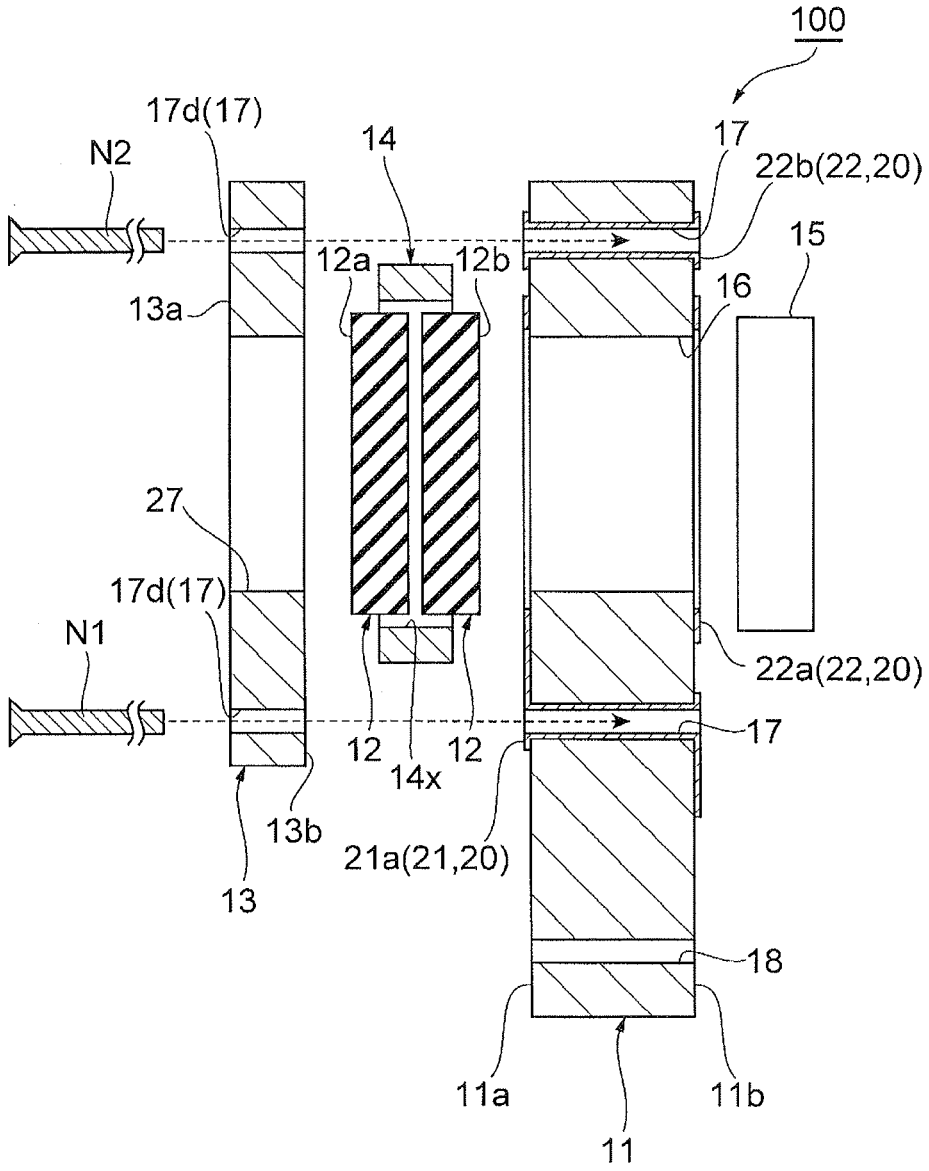
FIG. 3 is a cross-sectional view taken along a line of FIG. 1.

First, a first embodiment will be described. An electron multiplier 100 of the present embodiment multiplies and detects electrons with high sensitivity, at a high speed, and with high resolution, as illustrated in FIGS. 1 to 3. The electron multiplier 100 may be applied, for example, to various electronic apparatuses such as a mass spectrometer, a semiconductor inspection apparatus, and a surface analysis apparatus. This electron multiplier 100 is a card type detector, and includes an insulating substrate 11, a plurality of (here, 2) stacked MCPs (micro-channel plates) 12, 12, a shield plate (a metal plate) 13, a centering substrate 14, and an anode 15.

The insulating substrate 11 is formed of a material (e.g., glass epoxy) having an insulating property and exhibits a long rectangular plate-shaped contour, as illustrated in FIGS. 1 to 4. A through-hole 16 extending in a thickness direction of the insulating substrate 11 (hereinafter referred to simply as a "thickness direction") is formed in the insulating substrate 11. The through-hole 16 is a space which causes electrons emitted from the MCP 12 to pass toward the anode 15. The through-hole 16 herein is formed in a circular shape when viewed in the thickness direction.

Further, a plurality of (four) fixing holes 17 extending in the thickness direction are provided as holes for fixing the shield plate 13 in the insulating substrate 11. Insulating screws N1 having an insulating property are fastened to the fixing holes 17*a* to 17*c* among the plurality of fixing holes 17. A conductive screw (a fastening member) N2 having conductive property is fastened to the fixing hole 17*d* among the plurality of fixing holes 17. Further, a plurality of (two) fixing holes 18 extending in the thickness direction are provided as holes for fixation to an external housing in the insulating substrate 11. Further, other fastening members such as bolts or nuts may be used as the insulating screw N1 and the conductive screw N2.

Further, a signal readout terminal 19 such as an SMA or BNC connector is provided as a terminal for reading an output signal of the anode 15 in one side surface of the insulating substrate 11. Specifically, a direction (axial direction) of the signal readout terminal 19 is a direction in a lateral direction (horizontal direction of FIG. 1) of the insulating substrate 11, and the signal readout terminal 19 is fixed to project outward in an end portion of the insulating substrate 11 in the lateral direction.

This insulating substrate 11 is a printed board, and includes an electrical wiring pattern 20 as a conductive member constituting a circuit wiring of the electron multiplier 100. The electrical wiring pattern 20 includes an electrical wiring pattern 21 provided to be stacked on a surface 11*a* (a surface on one side in the thickness direction) in the insulating substrate 11, and an electrical wiring pattern 22 provided to be stacked on a back surface 11*b* (a surface on the other side in the thickness direction) 11*b* of the insulating substrate 11. Further, the electrical wiring pattern 20 is appropriately coated with a resist, a parylene or the like, thereby increasing a withstand voltage.

Figure 4:
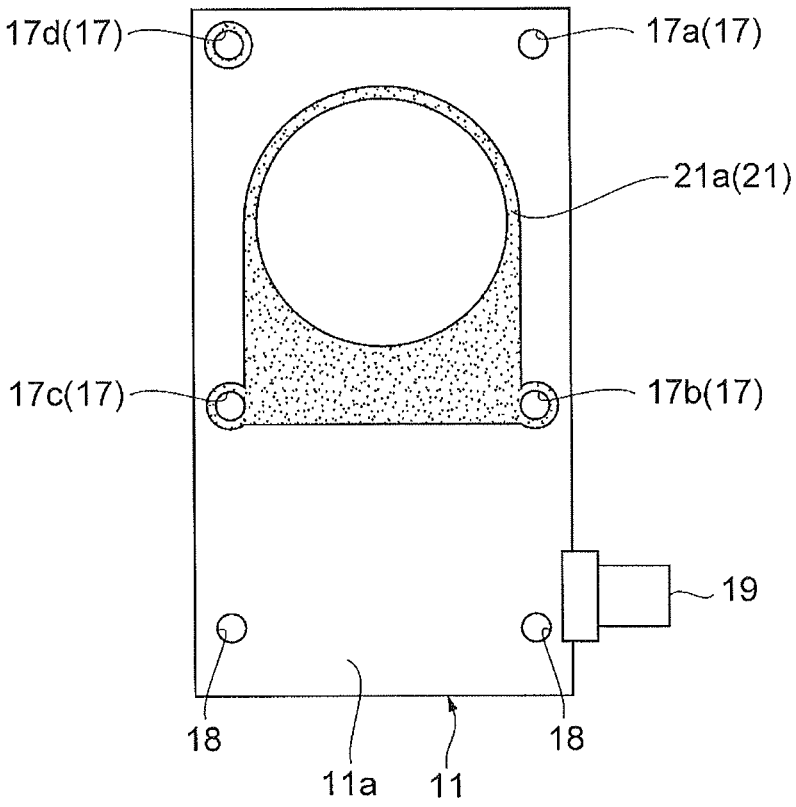
FIG. 4 is a schematic view illustrating an incidence surface side of an insulating substrate in the electron multiplier of FIG. 1.

The electrical wiring pattern 21 includes an MCP connection portion 21*a*, as illustrated in FIGS. 2 and 4. The MCP connection portion 21*a* is provided around the through-hole 16 and is electrically connected to an output side of the MCP 12. This MCP connection portion 21*a* is continuous to the electrical wiring pattern 22 on the back surface 11*b* side through the fixing holes 17*b*,17*d*.

The electrical wiring pattern 22 includes an anode connection portion 22*a*, a shield plate connection portion 22*b*, and lines 22*c* to 22*f*. The anode connection portion 22*a* is provided in a circumferential edge of the through-hole 16 and electrically connected with the anode 15. The shield plate connection portion 22*b* is provided in a circumferential edge of the fixing hole 17*d* and electrically connected to the shield plate 13.

The line 22*c* extends to electrically connect the anode connection portion 22*a* and the signal readout terminal 19. The line 22*d* is continuous to the MCP connection portion 21*a* through the fixing hole 17*b*, and extends to be electrically connected to the signal readout terminal 19. The line 22*e* is continuous to the MCP connection portion 21*a* through the fixing hole 17*c* and extends to be electrically connected to the line 22*c*. The line 22*f* is continuous to the line 22*e* and extends to be electrically connected to the shield plate connection portion 22*b*.

A capacitor C1 is surface-mounted on the line 22*c* in this electrical wiring pattern 22. A capacitor C2 is surface-mounted on the line 22*d*. A resistor R1 is surface-mounted on the line 22*f*. A resistor R2 is surface-mounted on the line 22*e*. Further, a resistor R3 is surface-mounted on the line 22*c* side relative to the resistor R2 in the line 22*e*.

Figure 6:
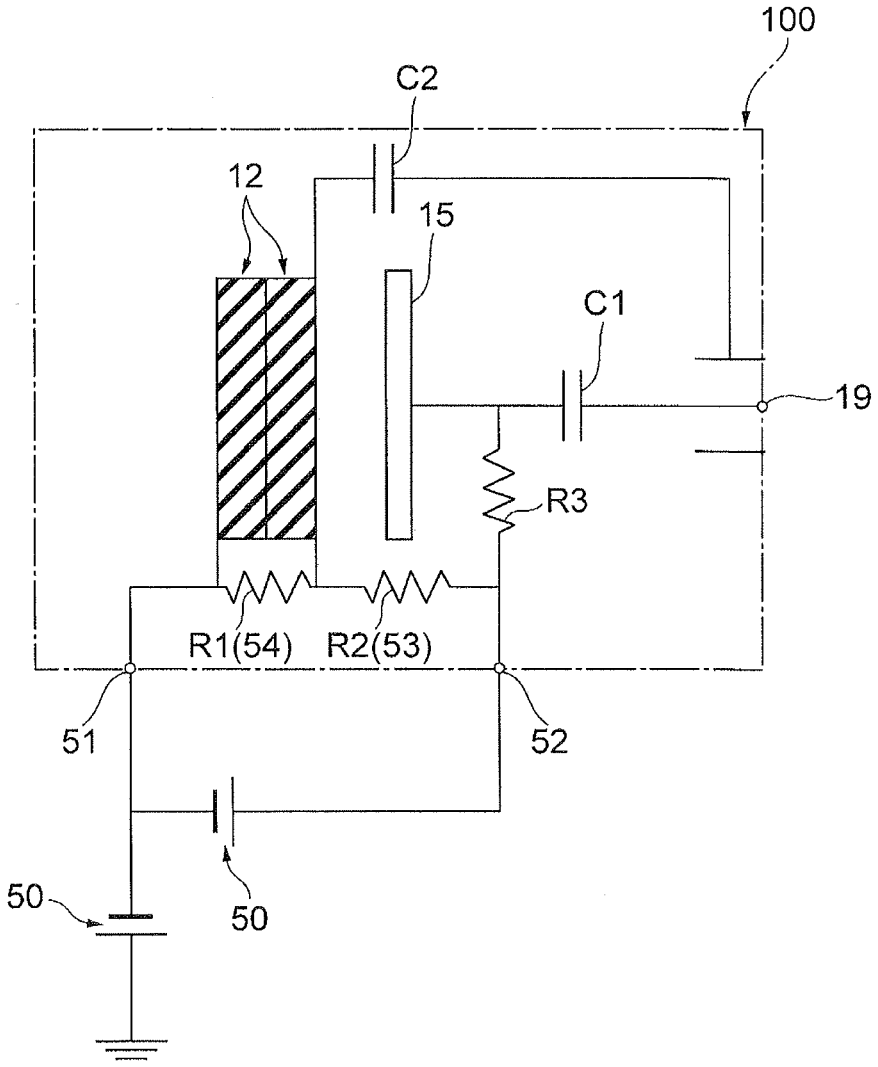
FIG. 6 is a diagram illustrating an equivalent circuit of the electron multiplier of FIG. 1.

Further, an IN-side electrode 51 is electrically connected on the shield plate connection portion 22*b* in the electrical wiring pattern 22. Further, a bias electrode 52 is electrically connected between the resistors R2, R3 of the line 22*e*. According to the electrical wiring pattern 20 formed in this way, a so-called floating type electrical circuit illustrated in FIG. 6 is configured.

Figure 5:
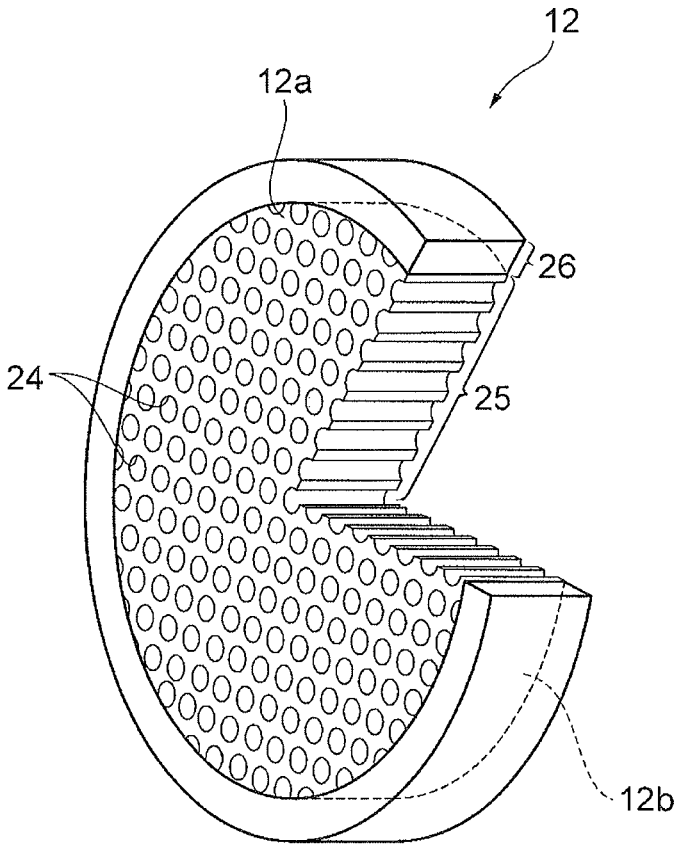
FIG. 5 is a perspective view illustrating a cut portion of an MCP in the electron multiplier of FIG. 1.

The MCP 12 multiplies and emits incident electrons, as illustrated in FIGS. 3, 5. The MCP 12 exhibits a greater diameter disk shape than the through-hole 16 of the insulating substrate 11. This MCP 12 includes a channel portion 25 in which a plurality of through-holes (channels) 24 penetrating in a thickness direction are formed; and a peripheral edge portion 26 which surrounds an outer periphery of the channel portion 25. The channel portion 25 is configured, for example, by forming a number of channels 24 each having an inner diameter of 2 to 25 μm in a circular area on an inward side relative to a peripheral edge portion 26 having a width of about 3 mm from an outer peripheral portion, for a disc-shaped glass substrate having a thickness of 100 to 2000 μm and a diameter of 10 to 120 mm.

Further, a metal functioning as an electrode for applying a voltage to the channel portion 25 is formed (not illustrated) in each of a surface 12*a* on an incidence side and a back surface 12*b* on an output side of the MCP 12 through deposition or the like. The deposited metal of the surface 12*a* of the MCP 12 constitutes an MCP input-side electrode (IN-side electrode) of the MCP 12. The deposited metal of the back surface 12*b* constitutes an MCP output-side electrode (OUT side electrode) of the MCP 12. Also, in the MCP 12 herein, a voltage is applied to the MCP input-side electrode through the IN-side electrode 51, and a voltage is applied to the MCP output-side electrode through the bias electrode 52.

In this MCP 12, when a high voltage of about 1 kV is applied between the electrodes, i.e., electrodes (the MCP input-side electrode and the MCP output-side electrode of the MCP 12), not illustrated, at both ends of each channel 24, an electric field orthogonal to an axis direction is generated in the channel 24. In this case, when electrons are incident on the channel 24 from one end side, the incident electrons are given energy from the electric field and collide with an inner wall of the channel 24, and secondary electrons are emitted. Also, such collision is repeated many times and electrons exponentially increase such that electron multiplication is performed and the electron-multiplied electrons are emitted and output from the other end side.

This MCP 12 is arranged on the through-hole 16 to overlap coaxially with the through-hole 16 on the surface 11*a* of the insulating substrate 11, as illustrated in FIG. 3. In other words, the MCP 12 is arranged on one side (left side in FIG. 3) which is an incidence side of the through-hole 16. In this case, the deposited metal of the back surface 12*b* of the MCP 12 comes in contact with the MCP connection portion 21*a*, and accordingly, the MCP output-side electrode of the MCP 12 is electrically connected to the wiring pattern 20.

The shield plate 13 has a shield function for shielding extra electrons directed to the MCP 12, as illustrated in FIGS. 1 and 3. The shield plate 13 exhibits a rectangular plate-shaped contour larger than the MCP 12 when viewed in the thickness direction, and has a surface 13*a* larger than the surface 12*a* of the MCP 12. This shield plate 13 is formed of a material with high rigidity which is not easily deformed (e.g., bent or warped), such as a metal such as stainless steel.

Further, a through-hole 27 extending in a thickness direction is formed in the shield plate 13. The through-hole 27 is a space which causes electrons incident on the MCP 12 to pass. The through-hole 27 herein is formed in a circular shape having a smaller diameter than the MCP 12 when viewed in the thickness direction. A back surface 13*b* of this shield plate 13 is an attachment surface for the MCP 12.

This shield plate 13 is arranged to overlap the surface 12*a* of the MCP 12 and includes the MCP 12 when viewed in the thickness direction. In this case, a portion of the MCP 12 is exposed from the through-hole 27 of the shield plate 13. Herewith, the back surface 13*b* of the shield plate 13 comes in contact with the surface 12*a* of the MCP 12, and is electrically connected to the MCP input-side electrode of the surface 12*a*. Accordingly, the shield plate 13 also functions as an IN electrode.

Also, in this state, the shield plate 13 is fastened and fixed to the insulating substrate 11 by the insulating screw N1 and the conductive screw N2. Accordingly, the MCPs 12, 12 are interposed in the thickness direction between the insulating substrate 11 and the shield plate 13 and fixed to be integral with the insulating substrate 11 and the shield plate 13. Herewith, the shield plate 13 and the shield plate connection portion 22*b* of the electrical wiring pattern 22 are connected electrically through the conductive screw N2.

The centering substrate 14 defines an attachment location of the MCP 12 between the insulating substrate 11 and the shield plate 13, as illustrated in FIG. 3. This centering substrate 14 is formed of an insulating material. The centering substrate 14 includes a hole 14*x* corresponding to a shape of the MCP 12 when viewed in the thickness direction. The centering substrate 14 is interposed and fixed between the insulating substrate 11 and the shield plate 13 in a state in which the MCPs 12, 12 are arranged in the hole 14*x*.

The anode 15 is an output and readout system which detects the electrons emitted from the MCP 12 and outputs an output signal according to the detection to the signal readout terminal 19. This anode 15 is arranged to overlap the through-hole 16 on the back surface 11*b* of the insulating substrate 11, as illustrated in FIG. 3. In other words, the anode 15 is arranged on the other side (the right side in FIG. 3) which is a side opposite to the incidence side in the through-hole 16. Accordingly, the anode 15 faces the MCP 12 through the through-hole 16. This anode 15 comes in contact with and is electrically connected to the anode connection portion 22*a*, and is fixed to the insulating substrate 11 by a bonding agent, such as a solder or a conductive adhesive.

In the electron multiplier 100 forming an electrical circuit illustrated in FIG. 6, which is configured as above, when electrons are incident on the MCPs 12 and 12 through the through-hole 27 of the shield plate 13 in a state in which a high voltage is applied to the IN-side electrode 51 and the bias electrode 52 by an operation power supply 50, the incident electrons proceed while being multiplied by the MCPs 12 and 12 and are taken out from the back surface 12*b* of the MCP 12. Also, the multiplied electrons are detected by the anode 15 and an output signal according to the detection is read from the signal readout terminal 19.

Further, at least one of the IN-side electrode 51 and the bias electrode 52 may include a conductive lead, and electrical connection with the external power supply may be made through the lead or at least one of the IN-side electrode 51 and the bias electrode 52 may include a connection terminal such as a clip or a connector. Further, a conductive line electrically connected to an external power supply may be electrically connected to the conductive screw N2 or the shield plate connection portion 22*b* instead of the electrical connection with the external power supply in the TN-side electrode 51 and the bias electrode 52. Further, while a potential is supplied from the bias electrode 52 to the MCP output-side electrode of the MCP 12 via a resistor R2, the potential may be supplied without the resistor R2.

In the above, the IN-side electrode 51 electrically connected to the external power supply, the conductive screw N2 and the shield plate connection portion 22*b* function as a voltage supply terminal which supplies a potential to the MCP input-side electrode of the MCP 12, and the bias electrode 52 functions as a voltage supply terminal which supplies a potential to the MCP output-side electrode of the MCP 12.

Incidentally, since a conventional electron multiplier is usually configured in a three-dimensional structure, it is necessary to consider three-dimensional arrangement of a high voltage wiring, and the structure can easily become complicated. Further, in the conventional electron multiplier, a number of parts are generally necessary to insulate a high voltage.

In this regard, in the present embodiment, a wiring is arranged as the electrical wiring pattern 20 in the insulating substrate 11, the anode 15 and the MCP 12 are mounted on this insulating substrate 11, the MCP 12 is shielded by the shield plate 13, and these are integrally configured. Accordingly, the following operational effects are achieved.

That is, reduction of the number of parts and simplification of the configuration can be achieved, a lightweight compact detector can be realized, and material cost can be reduced. Further, charge-up (in other words, the MCP 12 being charged and the incident electrons and the secondary electrons being deflected due to an adverse effect of the charging) of the MCP 12 can be suppressed by the shield plate 13 and operation of the electron multiplier 100 can be stabilized for high reliability. Further, handling of a high voltage becomes easy since the MCP 12 is arranged on the insulating material.

Further, the electrical wiring pattern 20 of the present embodiment includes the line 22*e* in which the resistor R2 is surface-mounted, as described above. In other words, a first bleeder circuit unit 53 including the resistor R2 is surface-mounted on the electrical wiring pattern 20 of the insulating substrate 11, and the MCP output-side electrode (the other side) of the MCP 12 is connected to the bias electrode 52 via the first bleeder circuit unit 53. Accordingly, a voltage supply terminal (e.g., an OUT-side electrode 501 which will be described below) for the MCP output-side electrode is unnecessary, and the number of wirings can be reduced. Further, the number of operation power supplies 50 can be reduced compared to a case in which the first bleeder circuit unit 53 is not included (e.g., an electron multiplier 500 which will be described below).

Here, it is found that a characteristic of the MCP 12 is changed due to a potential $V_{mcp}$ of the MCP 12 and a potential $V_{out\text{-}anode}$ between an output side of the MCP 12 and the anode 15. Specifically, it is found that the potential $V_{mcp}$ mainly contributes to a change in a gain, and the potential $V_{out\text{-}anode}$ mainly contributes to a change in a half value width of an output waveform and the gain. Further, when the first bleeder circuit unit 53 including the resistor R2 is included as in this embodiment, the potentials $V_{mcp}$, $V_{out\text{-}anode}$ are determined based on each of resistance values of the MCP 12 and the resistor R2 (e.g., see Equations (1) and (2) below). Thus, when there is a variation in the resistance value of the MCP 12, the voltage generated in the resistor R2 is also changed and, as a result, a characteristic of the output signal from the anode 15 may be greatly different.

Resistance value(20 MΩ) of MCP 12:Resistance value(5 MΩ) of resistor $R2=V_{mcp}$(2 kV): $V_{out\text{-}anode}$(500 V) (1)

Resistance value(80 MΩ) of MCP 12:Resistance value(5 MΩ) of resistor $R2=V_{mcp}$(2353 V): $V_{out\text{-}anode}$(147 V) (2)

Here, in Equations (1) and (2) above, the supply voltage is 2.5 kV.

Therefore, in the present embodiment, the line 22*f* on which the resistor R1 is surface-mounted is provided on the electrical wiring pattern 20, as described above. In other words, since a second bleeder circuit unit 54 including the resistor R1 having a smaller resistance value than the resistance value of the MCP 12 is inserted in parallel with the MCP 12 and accordingly a combined resistance value of the MCP 12 and the resistor R1 is dominant by the resistor R1, a voltage ratio between the potential $V_{mcp}$ and the potential $V_{out\text{-}anode}$ is determined based on a ratio of the resistance values of the resistors R1, R2. As a result, even when the resistance value of the MCP 12 is changed, a change in the potential $V_{mcp}$ and the potential $V_{out\text{-}anode}$ can be suppressed and the output signal can be stabilized for a stable operation.

Further, in the present embodiment, it is possible to easily and suitably fix and hold the electron multiplier 100 since the fixing hole 18 is provided in the insulating substrate 11, as described above.

Further, in the present embodiment, the shield plate 13 formed of a metal on the surface 12*a* on the incidence surface of the MCP 12 is installed, and the back surface 13*b* of this shield plate 13 is an attachment surface of the MCP 12, as described above. Thus, as rigidity and flatness are given to the MCP 12, a flatness degree of the MCP 12 surface can be increased (e.g., 30 μm or less) and characteristic improvement of the MCP 12 can be achieved even when the insulating substrate 11 is easily transformed.

Further, in the embodiment described above, the capacitor C1 is surface-mounted as a coupling capacitor, and an output signal from the anode 15 can be GND, namely, a potential difference between the output signal and a reference potential can be 0 V. Accordingly, it is possible to transfer the output signal to a processing system of a subsequent stage without sacrificing high speed.

Figure 7:
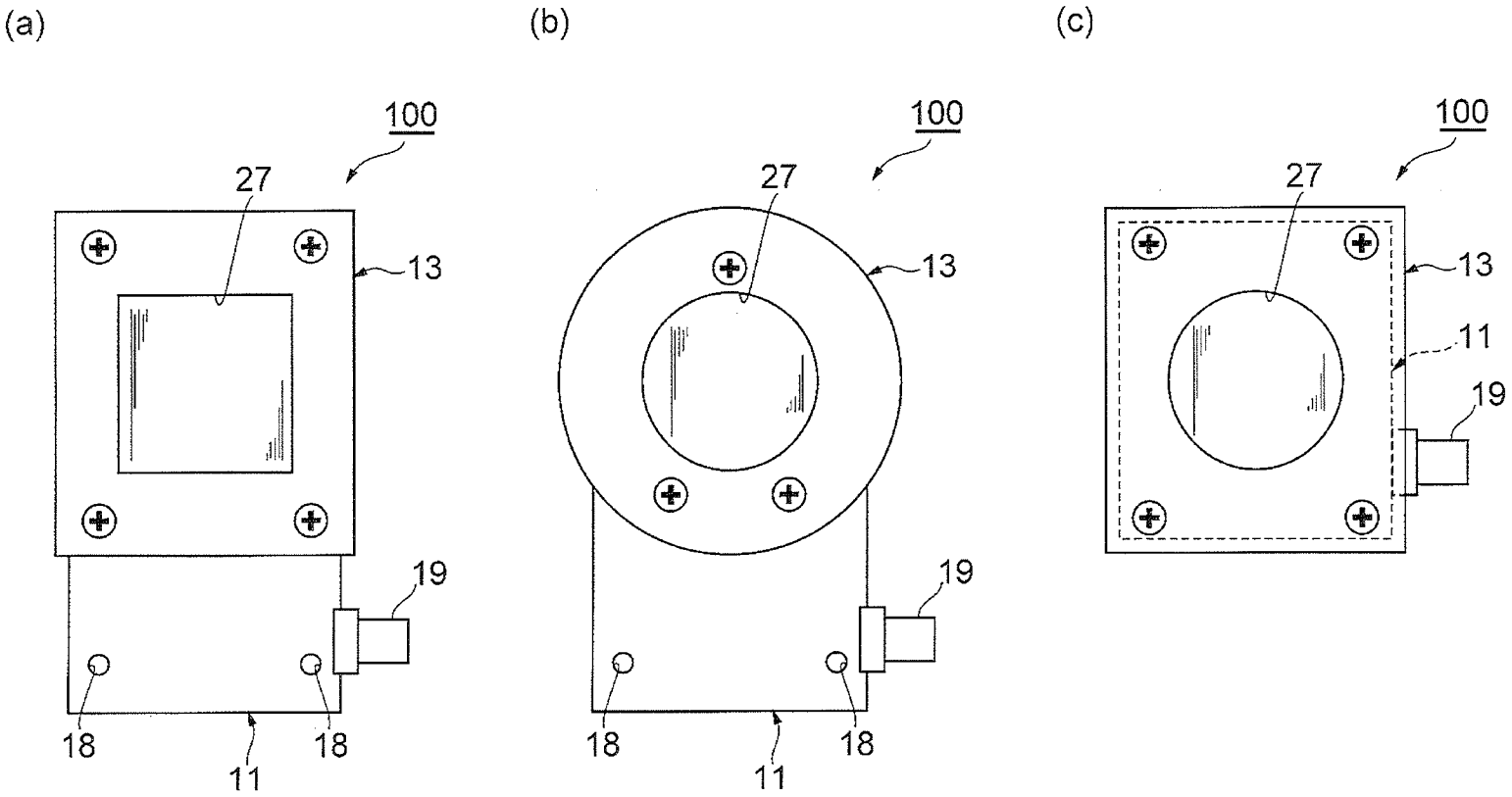
FIG. 7 is a schematic view illustrating an incidence surface side of a variant in the electron multiplier of FIG. 1.

Further, the electron multiplier 100 of the present embodiment is not limited to the above. For example, the through-hole 27 of the shield plate 13 may be formed in a rectangular shape when viewed in a thickness direction, as illustrated in FIG. 7(*a*). Further, the shield plate 13 may exhibit a circular plate-shaped contour, as illustrated in FIG. 7(*b*). Further, the shield plate 13 may be formed to be larger than the insulating substrate 11 so that the shield plate 13 includes the insulating substrate 11 when viewed in the thickness direction, as illustrated in FIG. 7(*c*). In other words, the insulating substrate 11 may be formed to be smaller than the shield plate 13 so that the insulating substrate 11 is included in the shield plate 13.

Figure 8:
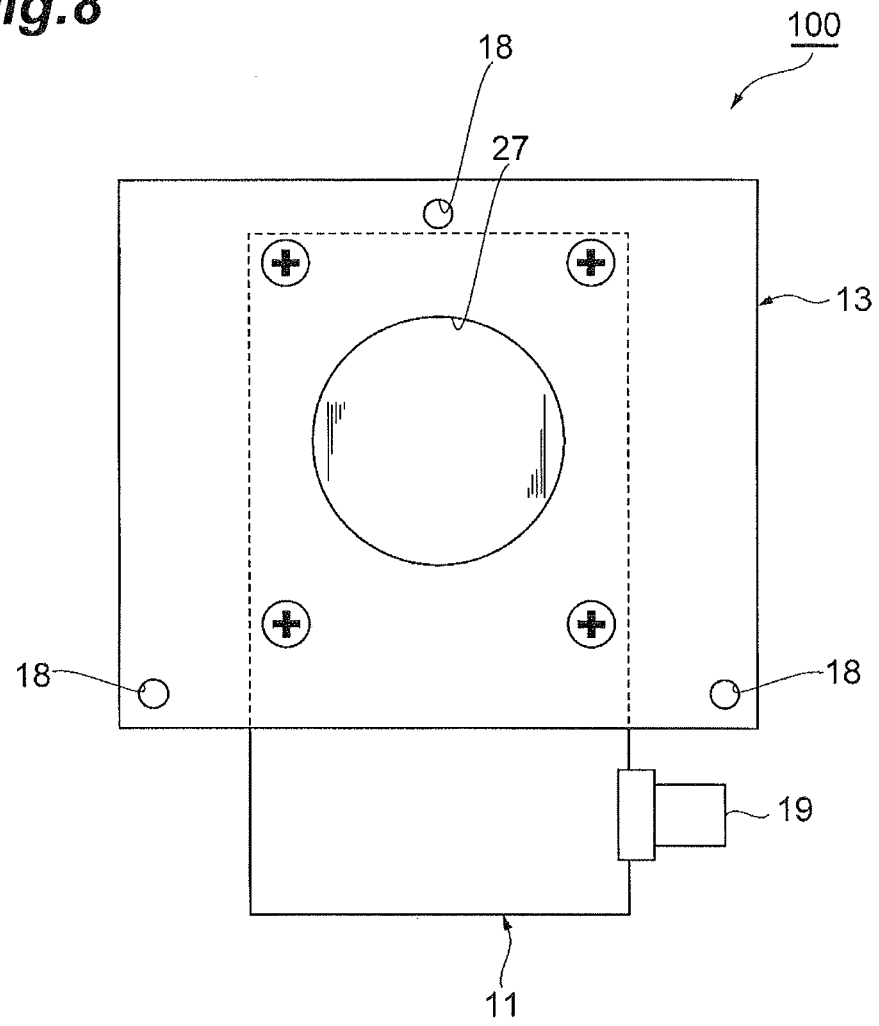
FIG. 8 is a schematic view illustrating an incidence surface side of another variant in the electron multiplier of FIG. 1.

Further, in the electron multiplier 100 of the present embodiment, while the fixing hole 18 for fixation to the housing or the like is provided in the insulating substrate 11, the fixing hole 18 may be provided in the shield plate 13, as illustrated in FIG. 8. In this case, the electron multiplier 100 can also be fixed and held easily and suitably.

Figure 9:
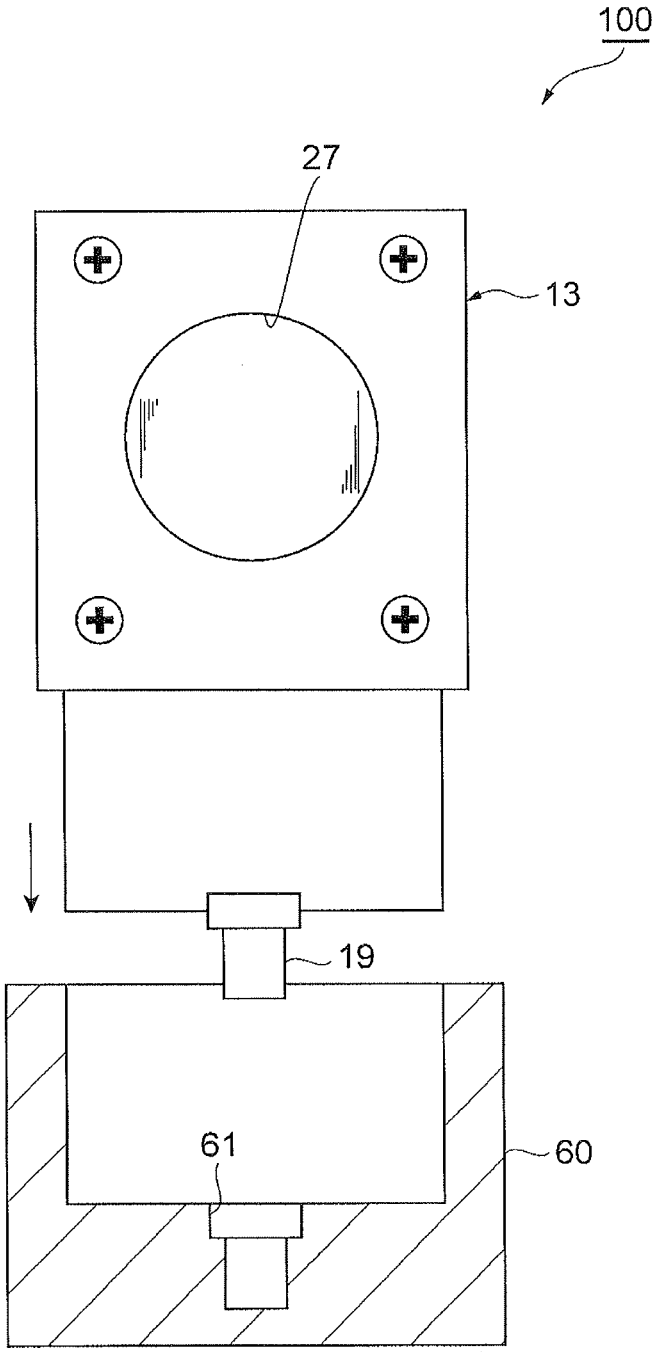
FIG. 9 is a schematic view illustrating an incidence surface side of still another variant in the electron multiplier of FIG. 1.

Further, the insulating substrate 11 may be configured to plug in a socket 60 in order to fix the electron multiplier 100, as illustrated in FIG. 9. In this case, the socket 60 may be electrically connected to the electron multiplier 100, as illustrated. Specifically, the signal readout terminal 19 is provided in an end portion in a longitudinal direction (a vertical direction in FIG. 9) of the insulating substrate 11, and a direction thereof is a direction in the longitudinal direction of the insulating substrate 11. A recess portion 61 in a shape corresponding to the signal readout terminal 19 is formed in the socket 60. Also, when the insulating substrate 11 plugs in the socket 60, the signal readout terminal 19 enters the recess portion 61 and is electrically connected to the socket 60 by the recess portion 61. In this case, the socket 60 is used for an electric wiring and fixation for the electron multiplier 100.

Figure 10:
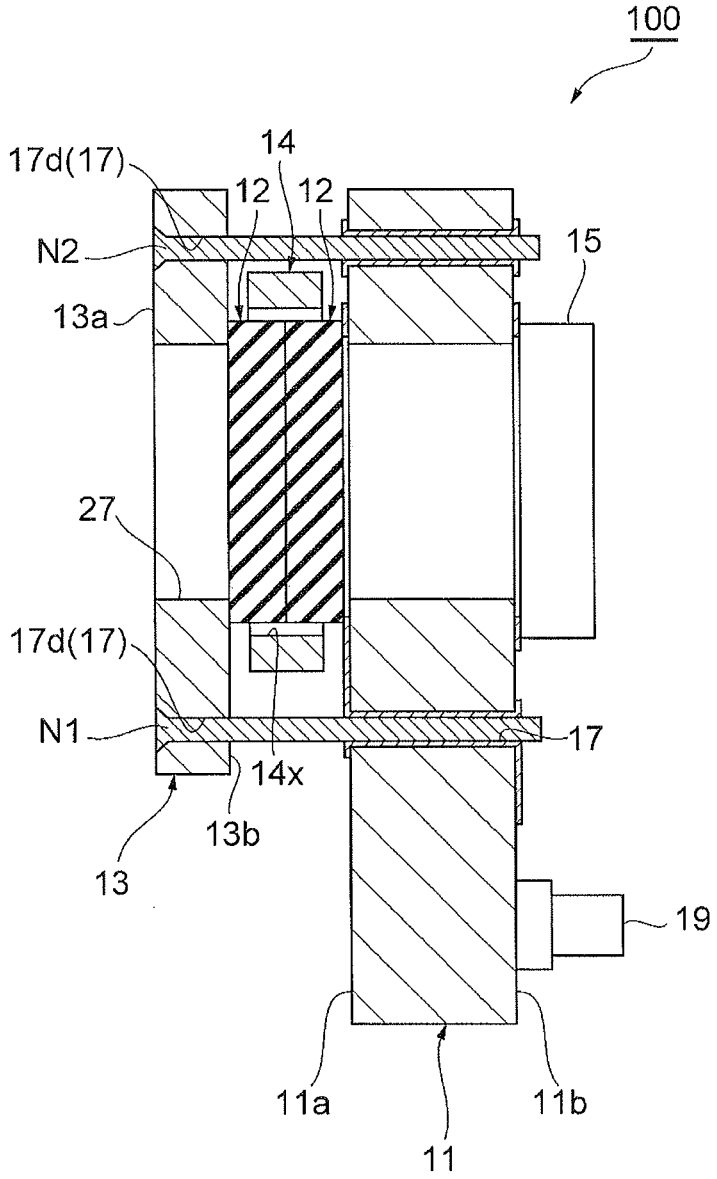
FIG. 10 is a cross-sectional view corresponding to FIG. 3 illustrating another variant in the electron multiplier of FIG. 1.

Further, the signal readout terminal 19 may be provided to be perpendicular to the back surface 11*b*, and a direction of the signal readout terminal 19 may be a direction (a direction orthogonal to the back surface 11*b*) in the thickness direction of the insulating substrate 11, as illustrated in FIG. 10.

Second Embodiment

Next, a second embodiment will be described. Further, differences between the present embodiment and the first embodiment will be mainly described in a description of the present embodiment.

Figure 11:
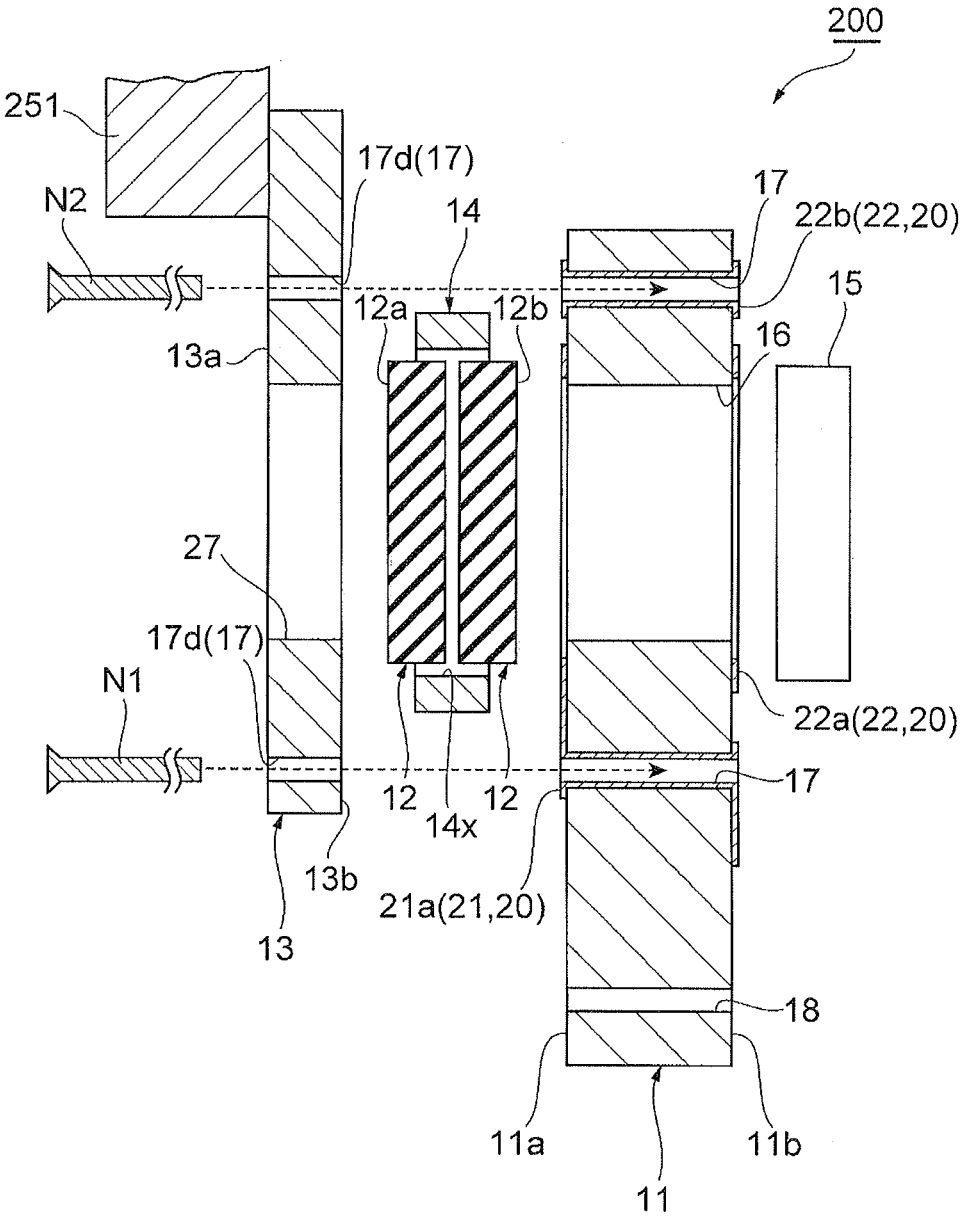
FIG. 11 is a cross-sectional view corresponding to FIG. 3 illustrating an electron multiplier according to a second embodiment.
Figure 12:
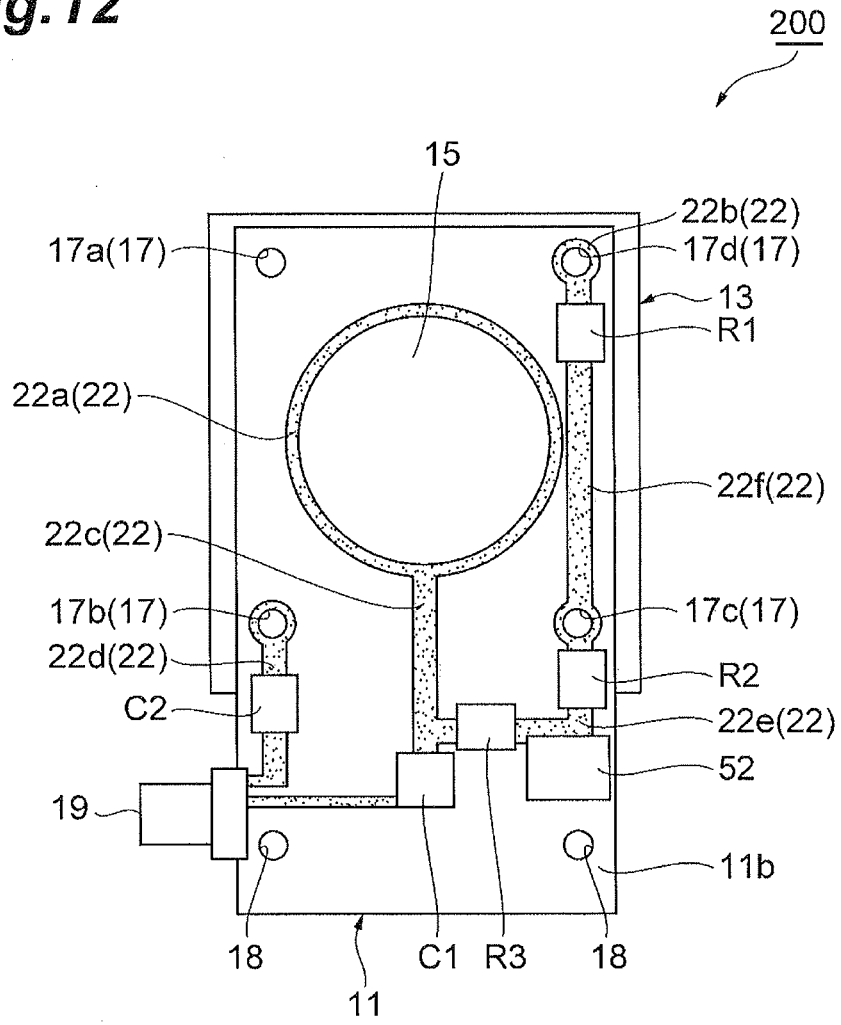
FIG. 12 is a schematic view illustrating an anode side of the electron multiplier of FIG. 11.
Figure 13:
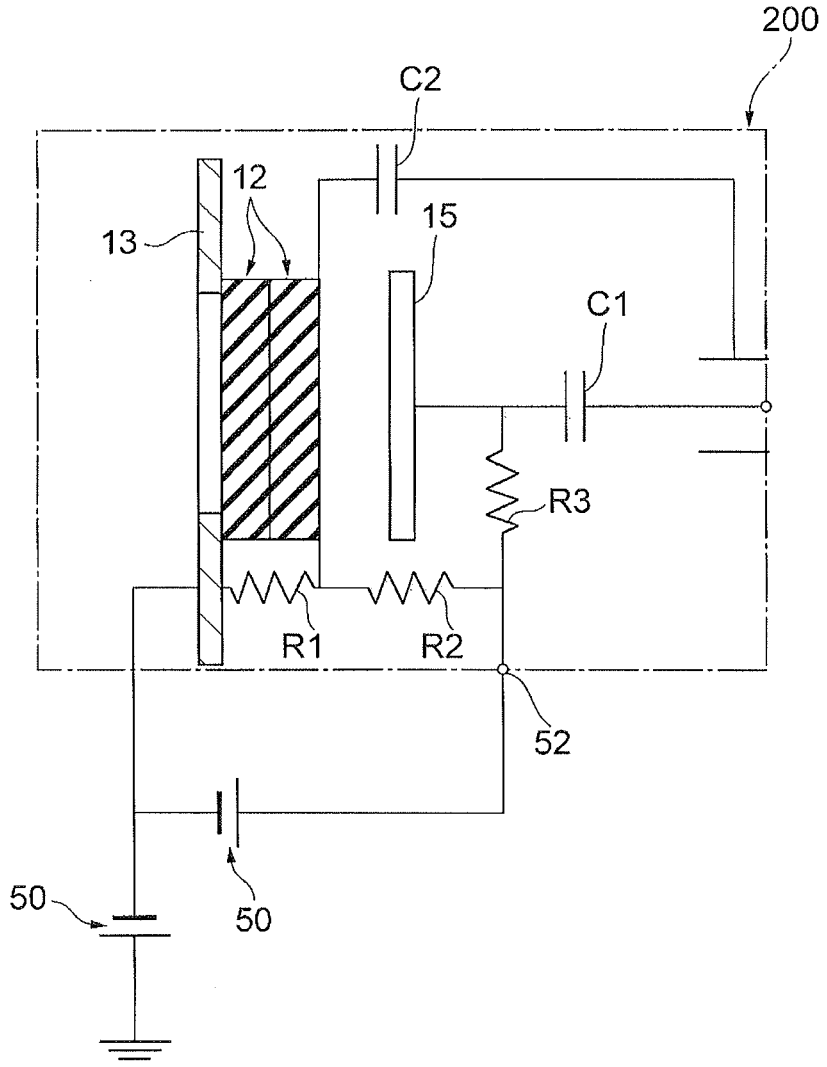
FIG. 13 is a diagram illustrating an equivalent circuit of the electron multiplier of FIG. 11.

A difference between an electron multiplier 200 of the present embodiment and the electron multiplier 100 is that an electrical wiring pattern 22 of an insulating substrate 11 does not include an IN-side electrode 51 (see FIG. 2), and an external housing 251 is connected to a shield plate 13 to directly apply a high voltage to be supplied to an MCP 12 to the shield plate 13, as illustrated in FIGS. 11 to 13.

The operational effects of cost reduction and high reliability are achieved in the present embodiment as well. Further, in the present embodiment, the IN-side electrode 51 on the electrical wiring pattern 22 can be made unnecessary and power supply wirings can be minimized, as described above.

Third Embodiment

Next, a third embodiment will be described. Further, differences between the third embodiment and the first embodiment will be mainly described in a description of the present embodiment.

Figure 14:
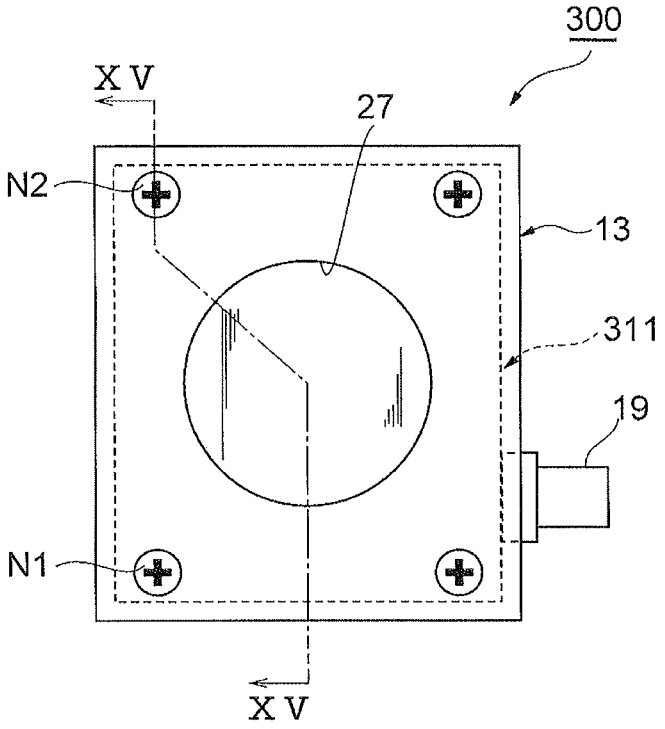
FIG. 14 is a schematic view illustrating an incidence surface side of an electron multiplier according to a third embodiment.
Figure 15:
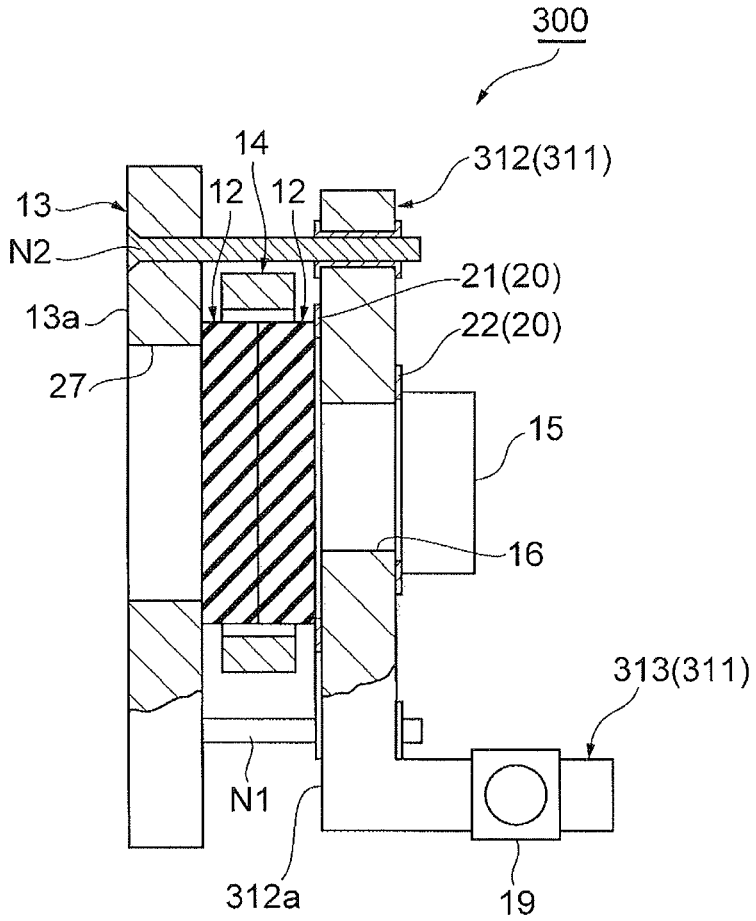
FIG. 15 is a cross-sectional view corresponding to FIG. 3 illustrating the electron multiplier of FIG. 14.

A difference between an electron multiplier 300 of the present embodiment and the electron multiplier 100 is that an insulating substrate 311 is included in place of the insulating substrate 11 (FIGS. 1 and 3), as illustrated in FIGS. 14 and 15. The insulating substrate 311 is formed to be smaller than a shield plate 13 and included in the shield plate 13 when viewed in a thickness direction. Specifically, the insulating substrate 311 is a refractive substrate refracted in an L shape when viewed from a lateral side, and includes a parallel portion 312 and a vertical portion 313.

The parallel portion 312 extends in parallel with the shield plate 13. The parallel portion 312 includes a surface 312*a* having a smaller area than a surface 13*a* of the shield plate 13, and is formed to be included in the shield plate 13 when viewed in the thickness direction. The through-hole 16 is formed in this parallel portion 312. The vertical portion 313 is continuous to one end portion of the parallel portion 312 and extends to be perpendicular to the parallel portion 312. The signal readout terminal 19 is provided on one side surface of the vertical portion 313. Further, the signal readout terminal 19 may be provided on the surface or a back surface of the insulating substrate 311 (the parallel portion 312 and the vertical portion 313).

The operational effects of cost reduction and high reliability are achieved in the present embodiment as well. Further, in the present embodiment, since the insulating substrate 11 is formed to be included in the shield plate 13 when viewed in the thickness direction as described above, and can have a small exclusive area when viewed in the thickness direction. Herewith, charge-up of the insulating substrate 11 can be suppressed by the shield plate 13 and operation of the electron multiplier 300 can be further stabilized.

Further, the electron multiplier 300 of the present embodiment is not limited to the above. For example, the insulating substrate 311 is a refractive substrate refracted in a U shape when viewed from a lateral side, and may include first and second parallel portions 321, 322 and a vertical portion (an intersecting portion) 323, as illustrated in FIG. 16(*a*).

The first and second parallel portions 321, 322 extend in parallel with the shield plate 13, and are formed to be included in the shield plate 13 when viewed in a thickness direction. The through-hole 16 is formed in the first parallel portion 321. An anode 15 is arranged to overlap the through-hole 16 in a back surface (a surface on the side of the second parallel portion 322) 321*b* of the first parallel portion 321. The second parallel portion 322 is arranged to be spaced at a predetermined distance on the anode 15 side (a right side in FIG. 16(*a*): the other side) of the first parallel portion 321. The signal readout terminal 19 is provided in one side surface of the second parallel portion 322.

The vertical portion 323 is continuous to one end portion of the first and second parallel portions 321, 322 and extends perpendicularly to the first and second parallel portions 321, 322 to connect the first and second parallel portions 321, 322. Further, a post 301 having an insulating property or conductive property is interposed between the first and second parallel portions 321, 322, and the second parallel portion 322 is supported by and fixed to the first parallel portion 321 by this post 301.

Figure 16:
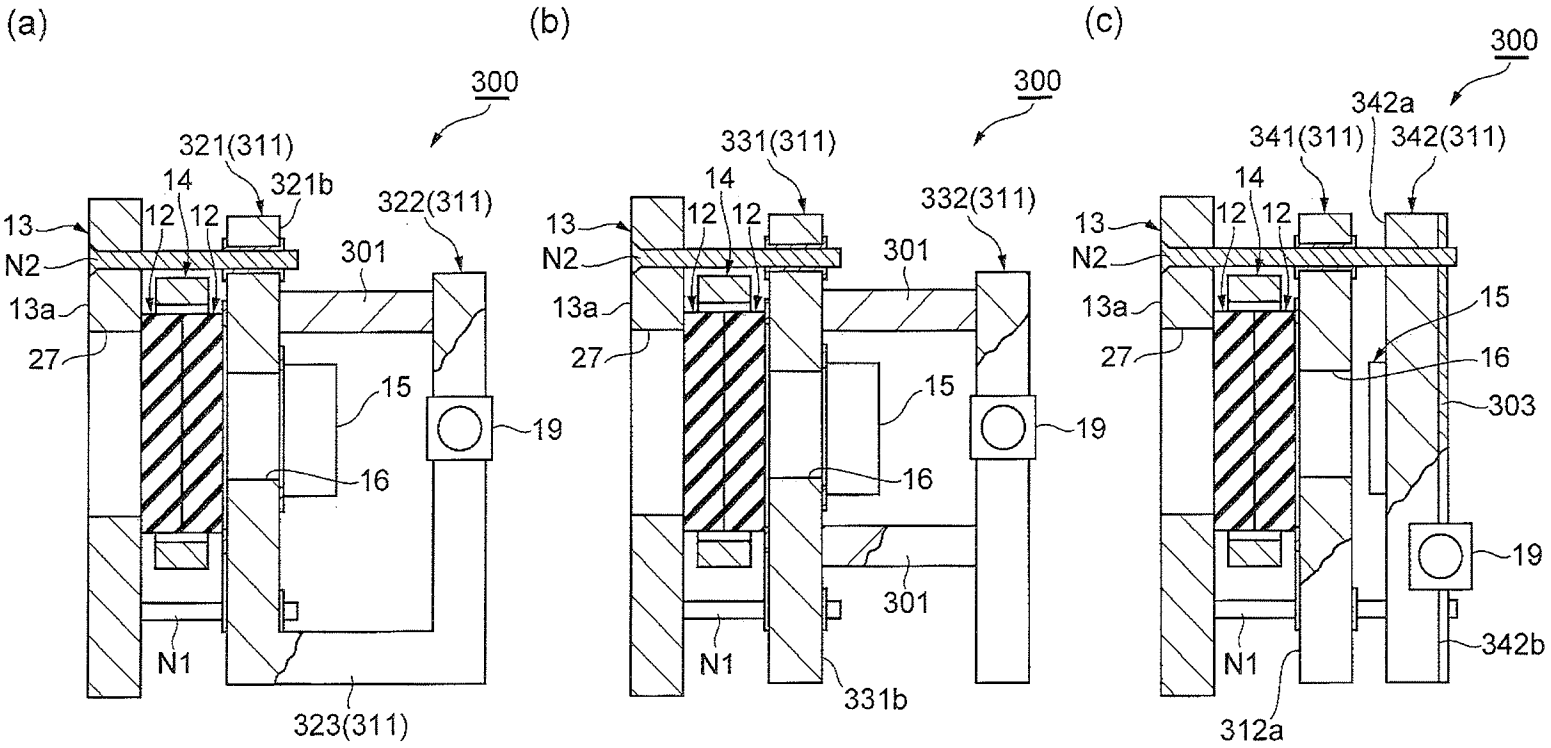
FIG. 16 is a schematic view corresponding to FIG. 3 illustrating a variant of the electron multiplier of FIG. 14.

Alternatively, an insulating substrate 311 may be formed in a stacked structure having first and second substrates 331, 332, as illustrated in FIG. 16(*b*). In this case, the first and second substrates 331, 332 extend in parallel with the shield plate 13, and are formed to be included in the shield plate 13 when viewed in a thickness direction.

Also, the through-hole 16 is formed in the first substrate 331. An anode 15 is arranged to overlap the through-hole 16 on a back surface (a surface on the second substrate 332 side) 331*b* of the first substrate 331. The second substrate 332 is arranged to be spaced at a predetermined distance on the anode 15 side (a right side in FIG. 16(*b*): the other side) of the first substrate 331. The signal readout terminal 19 is provided on one side surface of the second substrate 332. Further, a plurality of posts 301 having an insulating property or conductive property are interposed between the first and second substrates 331, 332, and the second substrate 332 is supported by and fixed to the first substrate 331 by the plurality of posts 301.

Alternatively, an insulating substrate 311 may include a multi-substrate in which an anode 15 is formed in the substrate, as illustrated in FIG. 16(*c*). In this case, the insulating substrate 311 is configured in a stacked structure having first and second substrates 341, 342, and the first and second substrates 341, 342 extend in parallel with the shield plate 13 and are formed to be included in the shield plate 13 when viewed in a thickness direction.

Also, the through-hole 16 is formed in the first substrate 341. The second substrate 342 is arranged to be spaced at a predetermined distance on the other side of the first substrate 341 (a right side in FIG. 16(*c*): the other side). The anode 15 is surface-mounted on the through-hole 16 above a surface 342*a* of the second substrate 342 on the first substrate 341 side. The signal readout terminal 19 is provided on one side surface of the second substrate 342. Further, the first and second substrates 341, 342 are fixed to each other by screws N1, N2. Accordingly, for support and fixation of the first and second substrates 341, 342, the post 301 can be omitted.

Further, while the first substrate 341 and the second substrate 342 are arranged to be spaced at a predetermined distance herein, the first substrate 341 and the second substrate 342 may be arranged to directly overlap or the first substrate 341 and the second substrate 342 may be integrally formed as a multi-layer stacked substrate.

Further, in this case, preferably, a noise shield portion 303 is formed on a back surface (a surface on the side opposite to the first substrate 341) 342*b* of the second substrate 342 to cover the back surface 342*b*. Accordingly, it is possible to reduce adverse effects of the noise. In addition, for example, when adverse effects of the noise are reduced, the noise shield portion 303 may not be provided.

Fourth Embodiment

Next, a fourth embodiment will be described. Further, differences between the present embodiment and the first embodiment will be mainly described in a description of the present embodiment.

Figure 17:
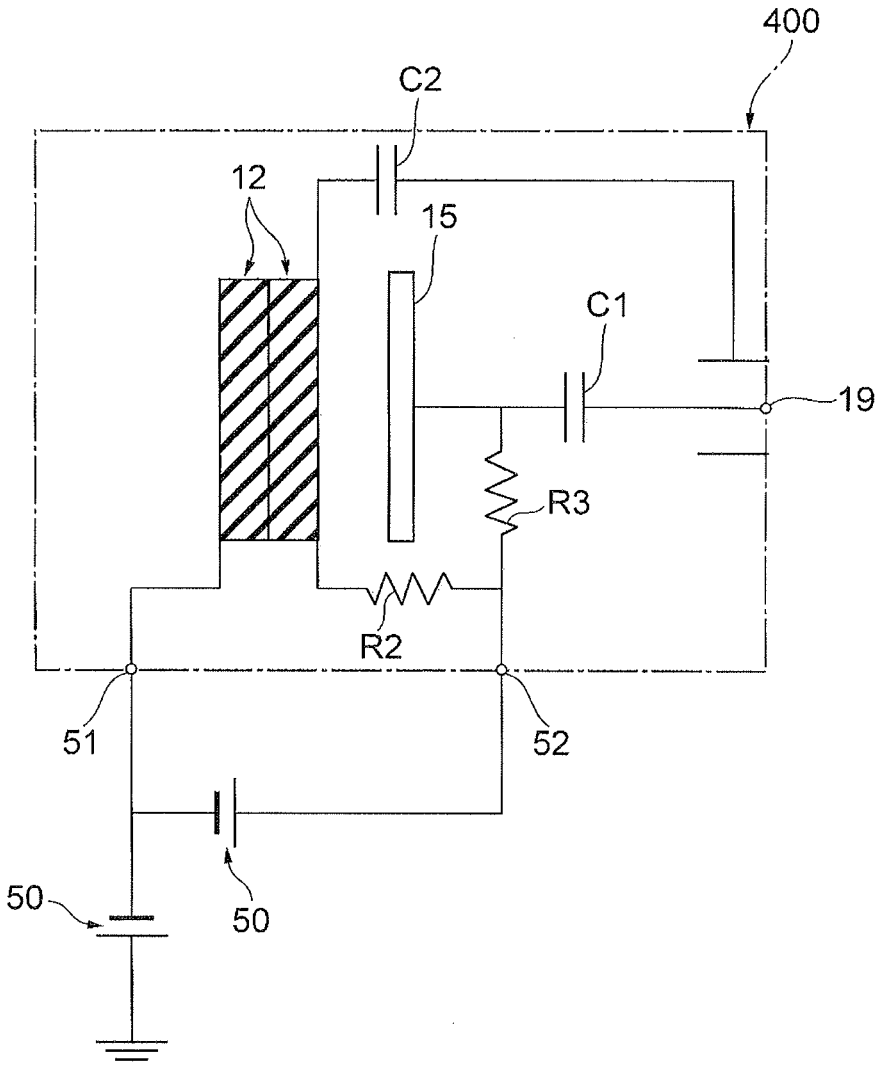
FIG. 17 is a diagram illustrating an equivalent circuit of an electron multiplier according to a fourth embodiment.

A difference between an electron multiplier 400 of the present embodiment and the electron multiplier 100 is that an electrical wiring pattern 22 does not include the line 22*f* and the resistor R1 (see FIG. 6), that is, the second bleeder circuit unit 54 is not surface-mounted on the electrical wiring pattern 22, as illustrated in FIG. 17.

The operational effects of cost reduction and high reliability are achieved in this embodiment as well. Further, in the present embodiment, it is possible to simplify a circuit configuration.

Fifth Embodiment

Next, a fifth embodiment will be described. Further, differences between the present embodiment and the first embodiment will be mainly described in a description of the present embodiment.

Figure 18:
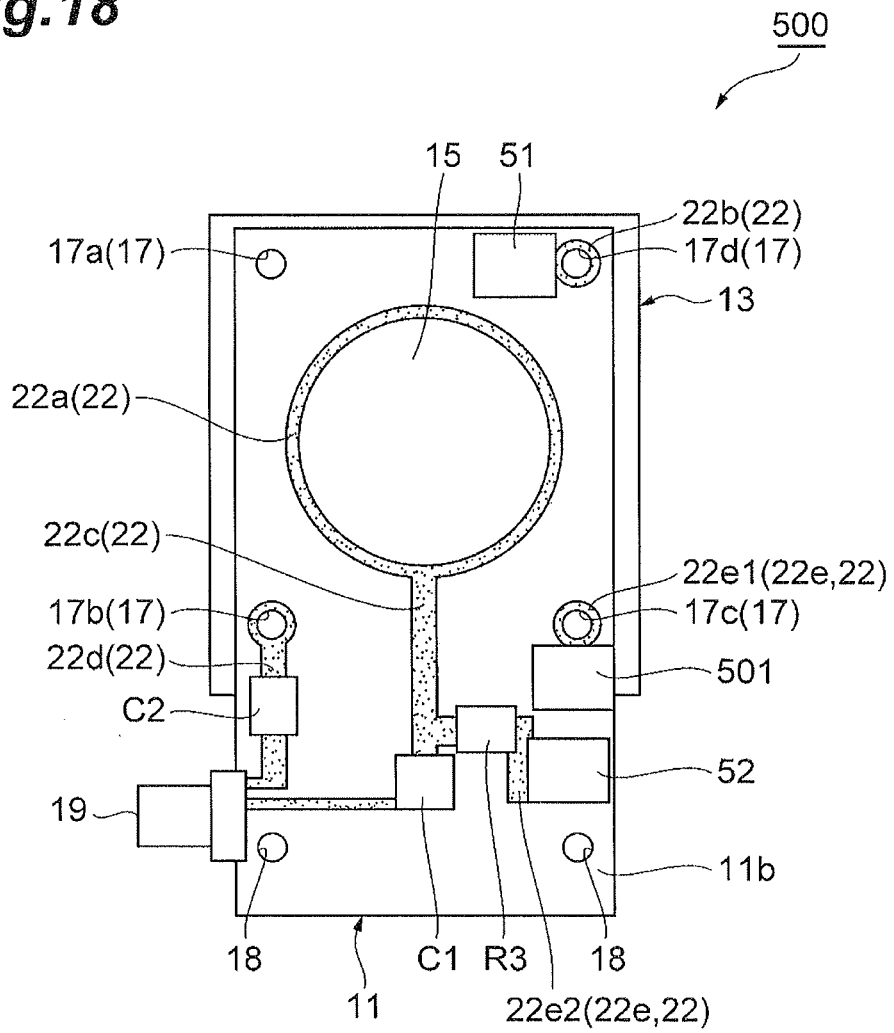
FIG. 18 is a schematic view illustrating an anode side of an electron multiplier according to a fifth embodiment.
Figure 19:
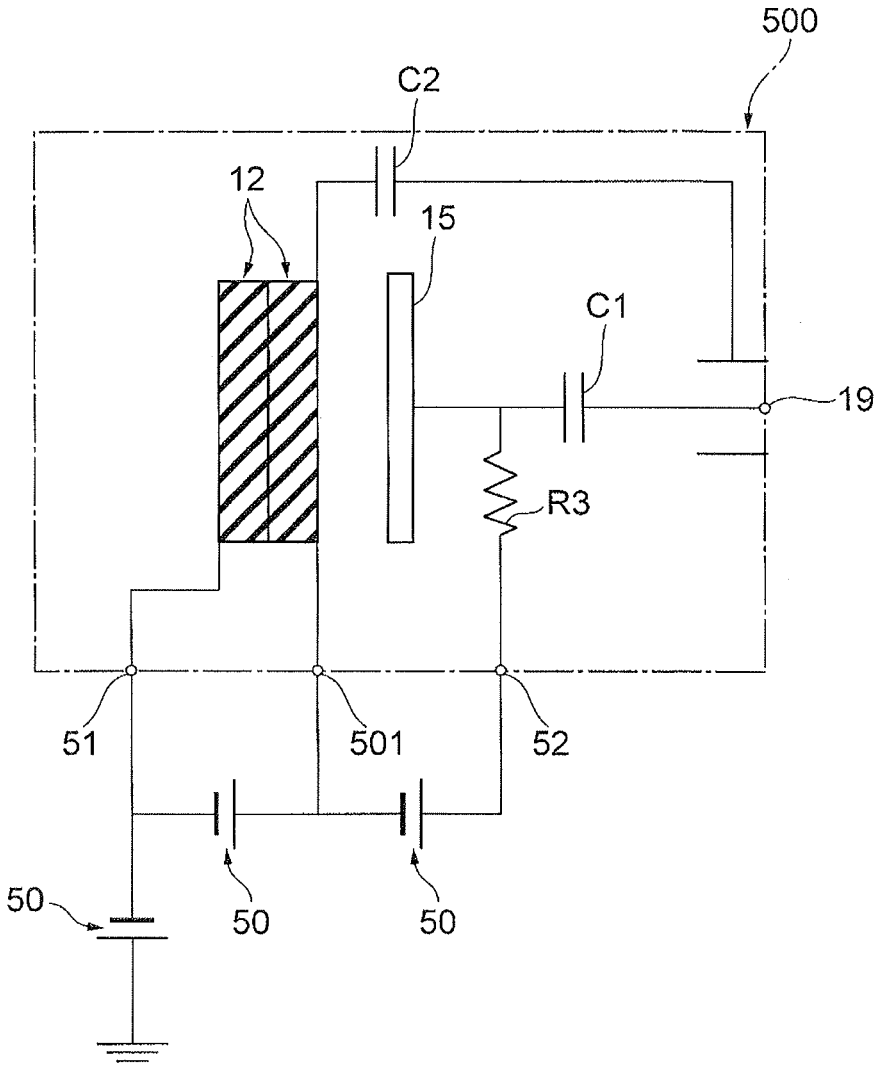
FIG. 19 is a diagram illustrating an equivalent circuit of the electron multiplier of FIG. 18.

A difference between an electron multiplier 500 of the present embodiment and the electron multiplier 100 is that the first and second bleeder circuit units 53, 54 are not surface-mounted on the electrical wiring pattern 22, as illustrated in FIGS. 18 and 19. In other words, in the electron multiplier 500, the electrical wiring pattern 22 does not include the line 22*f* and the resistors R1, R2 (see FIG. 6) and further the electrical wiring pattern 22 includes an OUT electrode 501 and a line 22*e* is divided.

The line 22*e* is divided into lines 22*e*1, 22*e*2 between a fixing hole 17*c* and a bias electrode 52. The OUT-side electrode 501 is surface-mounted on the line 22*e*1 on the fixing hole 17*c* side. Accordingly, the OUT-side electrode 501 is electrically connected to an MCP output-side electrode of the MCP 12 and functions as a voltage supply terminal which supplies a potential to the MCP output-side electrode of the MCP 12.

Further, the OUT electrode 501 may include a conductive lead, and an electrical connection with an external power supply may be made via the lead. Further, the OUT-side electrode 501 may include a connection terminal such as a clip or a connector. Further, a conductive line electrically connected to the external power supply may be electrically connected to the line 22*e*1, instead of the electrical connection with the external power supply in the OUT electrode 501.

The operational effects of cost reduction and high reliability are achieved in the present embodiment described above as well. Further, in the present embodiment, it is possible to simplify a circuit configuration.

Sixth Embodiment

Next, a sixth embodiment will be described. Further, differences between the present embodiment and the first embodiment will be mainly described in a description of the present embodiment.

Figure 20:
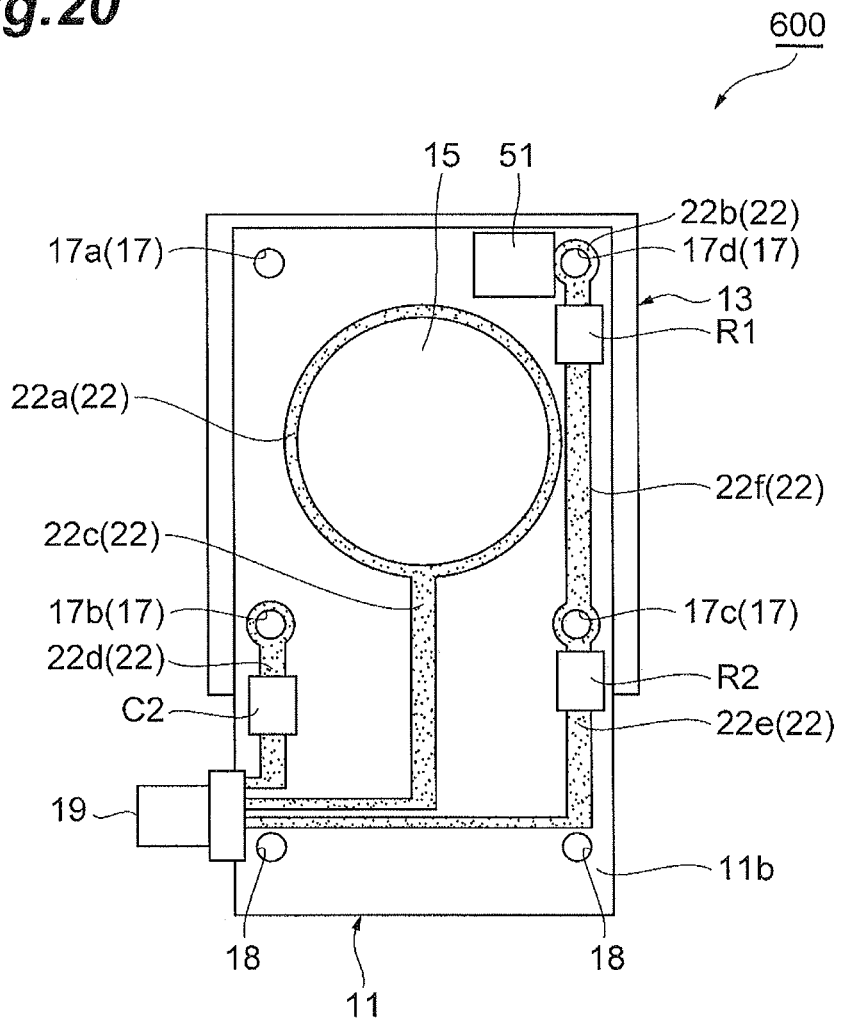
FIG. 20 is a schematic view illustrating an anode side of an electron multiplier according to a sixth embodiment.
Figure 21:
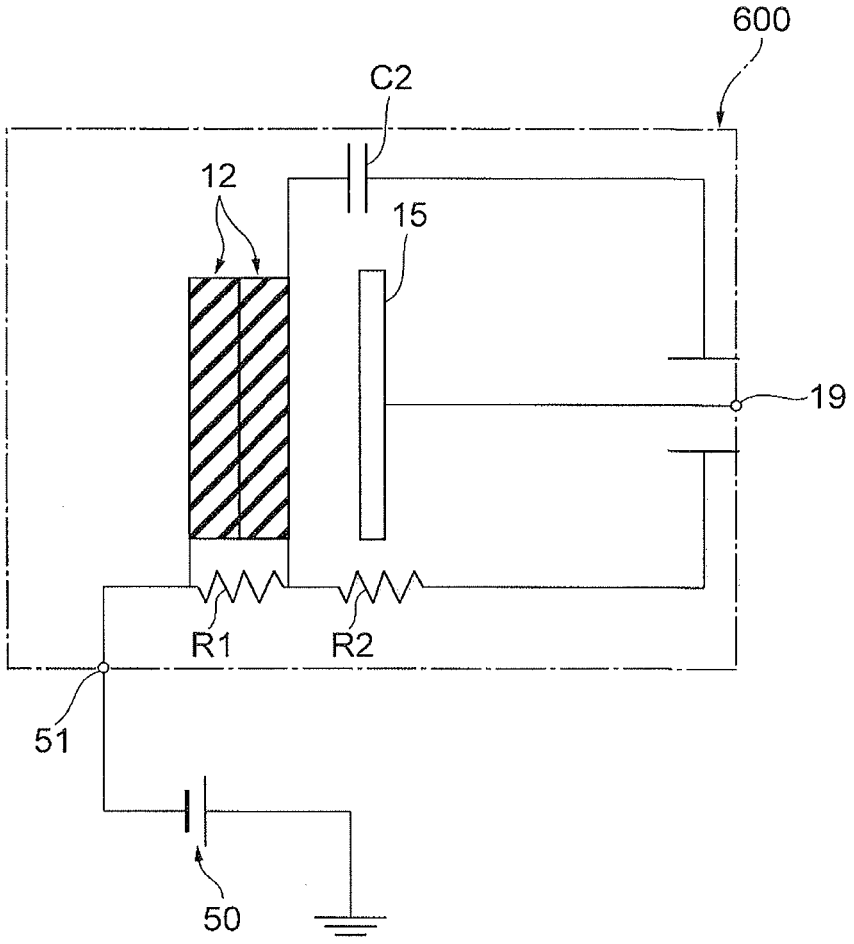
FIG. 21 is a diagram illustrating an equivalent circuit of the electron multiplier of FIG. 20.

An electron multiplier 600 of the present embodiment has a so-called GND type circuit configuration, as illustrated in FIGS. 20 and 21. A difference between this electron multiplier 600 and the electron multiplier 100 is that an electrical wiring pattern 22 does not include the bias electrode 52, the capacitor C1 and the resistor R3.

The operational effects of cost reduction and high reliability are achieved in the present embodiment described above as well. Further, in the present embodiment, it is possible to simplify a circuitry configuration and reduce the number of operation power supplies 50.

Seventh Embodiment

Next, a seventh embodiment will be described. Further, differences between the present embodiment and the second embodiment will be mainly described in a description of the present embodiment.

Figure 22:
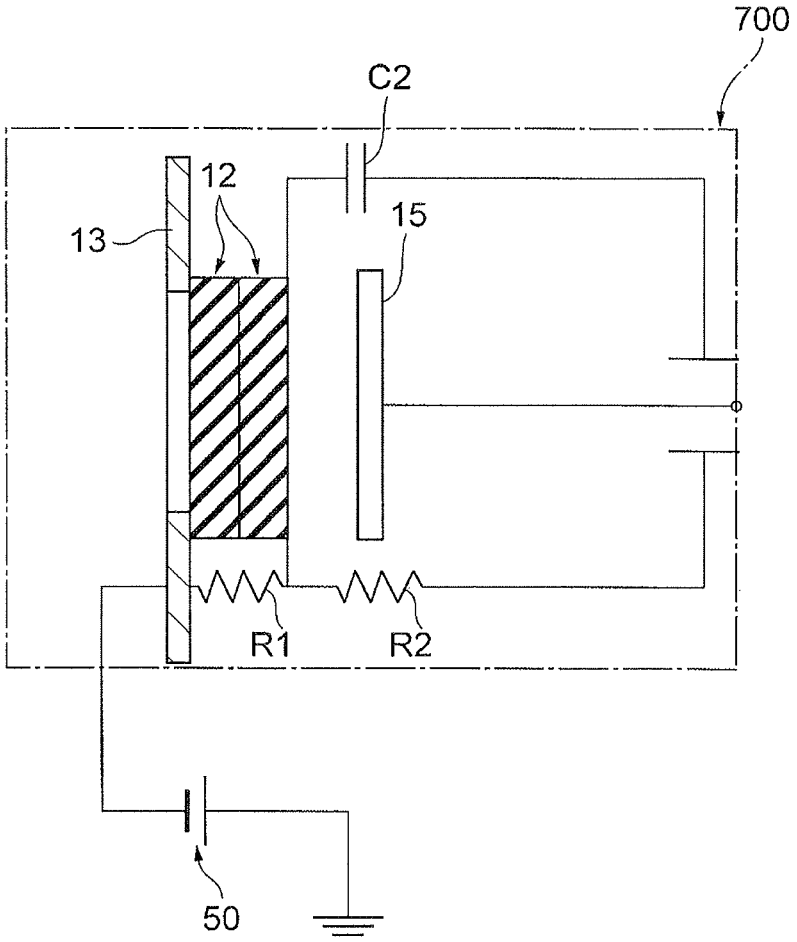
FIG. 22 is a diagram illustrating an equivalent circuit of an electron multiplier according to a seventh embodiment.

An electron multiplier 700 of the present embodiment has a so-called GND type circuit configuration, as illustrated in FIG. 22. A difference between this electron multiplier 700 and the electron multiplier 200 is that an electrical wiring pattern 22 does not include the bias electrode 52, the capacitor C1 and the resistor R3.

The operational effects of cost reduction and high reliability are achieved in the present embodiment described above as well. Further, in the present embodiment, it is possible to simplify a circuitry configuration and reduce the number of operation power supplies 50.

Eighth Embodiment

Next, an eighth embodiment will be described. Further, differences between the present embodiment and the fourth embodiment will be mainly described in a description of the present embodiment.

Figure 23:
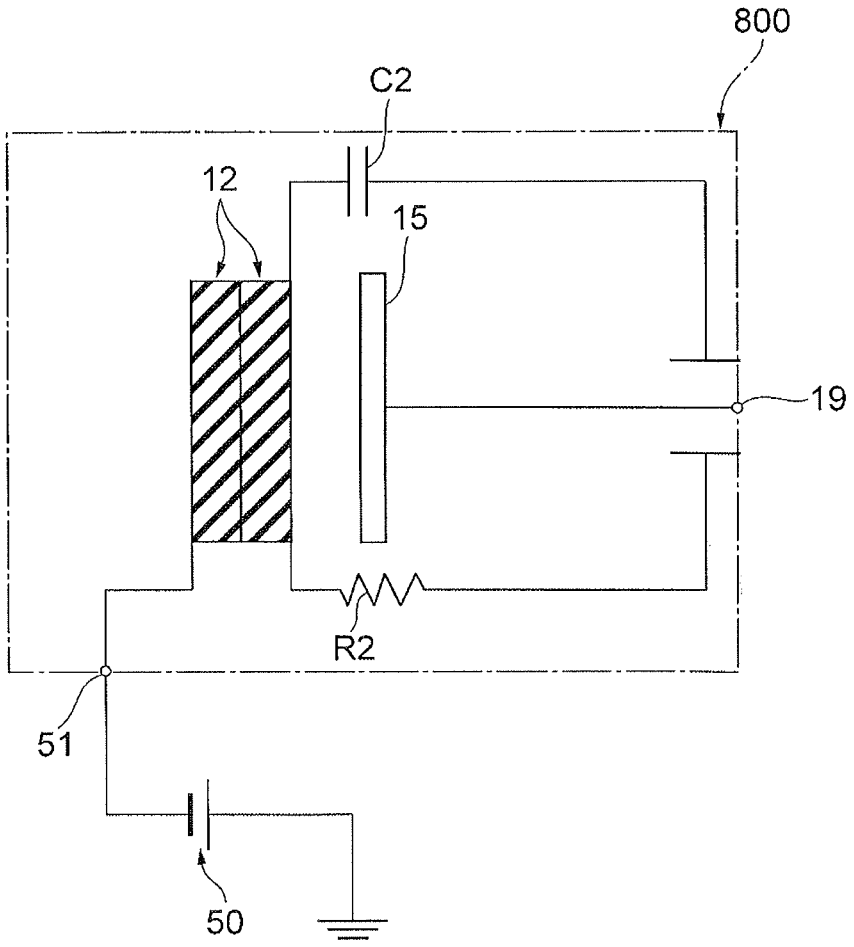
FIG. 23 is a diagram illustrating an equivalent circuit of an electron multiplier according to an eighth embodiment.

An electron multiplier 800 of the present embodiment has a so-called GND type circuit configuration, as illustrated in FIG. 23. A difference between this electron multiplier 800 and the electron multiplier 400 described above is that an electrical wiring pattern 22 does not include the bias electrode 52, the capacitor C1 and the resistor R3.

The operational effects of cost reduction and high reliability are achieved in the present embodiment described above as well. Further, in the present embodiment, it is possible to simplify a circuitry configuration and reduce the number of operation power supplies 50.

Ninth Embodiment

Next, a ninth embodiment will be described. Further, differences between the present embodiment and the fifth embodiment will be mainly described in a description of the present embodiment.

Figure 24:
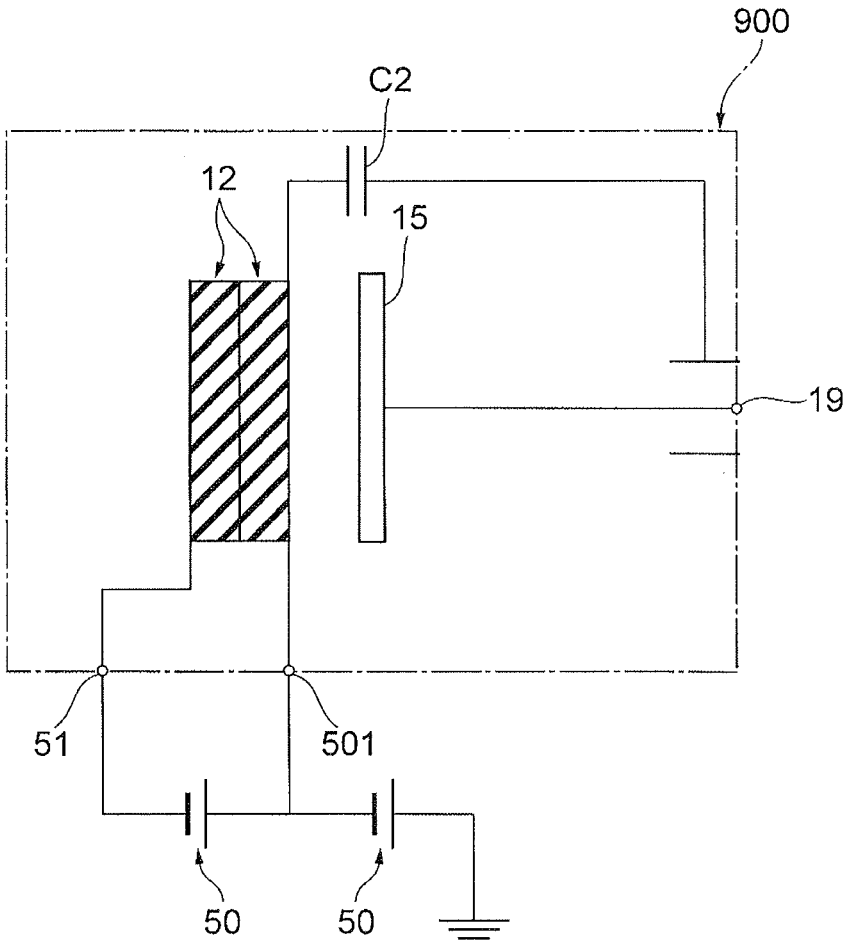
FIG. 24 is a diagram illustrating an equivalent circuit of an electron multiplier according to a ninth embodiment.

An electron multiplier 900 of the present embodiment has a so-called GND type circuit configuration, as illustrated in FIG. 24. A difference between this electron multiplier 900 and the electron multiplier 500 is that an electrical wiring pattern 22 does not include the bias electrode 52, the capacitor C1 and the resistor R3.

The operational effects of cost reduction and high reliability are achieved in the present embodiment described above as well. Further, in the present embodiment, it is possible to simplify a circuitry configuration and reduce the number of operation power supplies 50.

While the preferred embodiments have been described above, the electron multiplier according to the embodiments is not limited to the above and may be changed and variously applied as long as the gist defined in each claim is not changed.

For example, in the embodiment, while the electrons are multiplied and detected, an ultraviolet ray, a vacuum ultraviolet ray, a neutron radiation, an X ray and a γ ray, as well as ions, may be multiplied and detected. Further, in the embodiment, a constant voltage element such as a Zener diode may be attached in place of the resistor R2. In this case, it is preferable to increase thermal conductivity of the insulating substrate 11 for promotion of heat radiation from the constant voltage element.

Further, in the embodiment, while the insulating substrate 11 is formed of glass epoxy, the insulating substrate 11 may be formed of a super heat-resistant polymer resin (e.g., PEEK: polyetheretherketone), a ceramic of an inorganic material, or the like. In this case, it is possible to reduce a gas generated from the insulating substrate 11 to realize a long lifespan, and reduce noise by sensing a release gas. Particularly, when the ceramic is used for the insulating substrate 11, effective cooling can be realized due to excellent heat conduction.

Further, in the embodiment, while the two MCPs 12 are included, the number of MCPs 12 is not limited and one or three or more MCPs 12 may be included. Further, the MCP 12 may be directly adhered to the insulating substrate 11 and, accordingly, the number of parts can be further reduced. Further, the thickness of the insulating substrate 11, 311 may be equal to or more than a predetermined thickness, and accordingly, transformation of the insulating substrate can be prevented.

Further, a notch groove may be formed in the back surface 11*b* of the insulating substrate 11 and the electrical wiring pattern 20 may be provided on this notch groove. In this case, it is possible to suppress withstand voltage leakage by extending a surface distance of the electrical wiring pattern 20.

Further, while the embodiment is a single-anode-type electron multiplier including one anode 15, the embodiment may be a multi-anode-type electron multiplier including a plurality of anodes 15. In this case, it is possible to detect a two-dimensional position of incident electrons.

INDUSTRIAL APPLICABILITY

According to the present invention, it is possible to reduce cost and increase reliability.

REFERENCE SIGNS LIST

11, 311 . . . Insulating substrate, 12 . . . MCP (micro-channel plate), 13 . . . Shield plate (metal plate), 15 . . . Anode, 16 . . . Through-hole, 18 . . . Fixing hole, 19 . . . Signal readout terminal, 20, 21, 22 . . . Electrical wiring pattern,

27 . . . Through-hole, 52 . . . Bias electrode (voltage supply terminal), 53 . . . First bleeder circuit unit, 54 . . . Second bleeder circuit unit, 100, 200, 300, 400, 500, 600, 700, 800, 900 . . . Electron multiplier, 301 . . . Post, 303 . . . Noise shield portion, 321 . . . First parallel portion, 322 . . . Second parallel portion, 323 . . . Vertical portion (intersecting portion), 331, 341 . . . First substrate, 332, 342 . . . Second substrate, N2 . . . Conductive screw (fastening member)

The invention claimed is:

1. An electron multiplier comprising:

an insulating substrate which includes an electrical wiring pattern and in which a through-hole extending in a thickness direction is formed, wherein the electrical wiring pattern includes a first electrical wiring pattern provided on a first surface of the insulating substrate and a second electrical wiring pattern provided on a back surface of the insulating substrate;

a micro-channel plate arranged on the insulating substrate on one side of a through-hole of the insulating substrate in the thickness direction and electrically connected to the electrical wiring pattern, wherein the first electrical wiring pattern includes a micro-channel plate connection that is formed around the through-hole of the insulating substrate on the first surface side and electrically connected to the micro-channel plate;

a metal plate arranged on one side of the micro-channel plate in the thickness direction and electrically connected to the micro-channel plate;

an anode arranged on the insulating substrate on the other side of a through-hole of the insulating substrate in the thickness direction and electrically connected to the electrical wiring pattern, wherein the second electrical wiring pattern is electrically connected to the anode; and a signal readout terminal provided on and fixed to the insulating substrate for reading a signal from the anode through the electrical wiring pattern, wherein the metal plate is formed to include the micro-channel plate when viewed in the thickness direction, and a through-hole exposing at least a portion of the micro-channel plate is formed in the metal plate, the insulating substrate, the micro-channel plate, the metal plate and the anode are fixed to each other to be integral, the second electrical wiring pattern includes a capacitor and is electrically connected to the signal readout terminal, the metal plate is fixed directly to the insulating substrate by a fastening member, and the micro-channel plate is interposed between the insulating substrate and the metal plate and fixed to the insulating substrate and the metal plate.

2. The electron multiplier according to claim 1, wherein: in the electrical wiring pattern, an output side of the micro-channel plate is connected to a voltage supply terminal which is electrically connected to the other side of the micro-channel plate through a first bleeder circuit unit.

3. The electron multiplier according to claim 2, wherein, in the electrical wiring pattern, a second bleeder circuit unit having a smaller resistance value than resistance value of the micro-channel plate is connected to be in parallel with the micro-channel plate.

4. The electron multiplier according to claim 1, wherein a voltage to be supplied to one side of the micro-channel plate is applied to the metal plate.

5. The electron multiplier according to claim 1, wherein the metal plate is formed to include the insulating substrate when viewed in the thickness direction.

6. The electron multiplier according to claim 1, wherein the micro-channel plate is interposed between the insulating substrate and the metal plate and fixed to the insulating substrate and the metal plate.

7. The electron multiplier according to claim 1, wherein the metal plate is fixed to the insulating substrate by a conductive fastening member and electrically connected to the electrical wiring pattern.

8. The electron multiplier according to claim 1, wherein the anode is fixed to the insulating substrate by a conductive bonding agent and electrically connected to the electrical wiring pattern.

9. The electron multiplier according to claim 1, wherein a fixing hole for fixation to the outside is provided in at least one of the insulating substrate and the metal plate.

10. The electron multiplier according to claim 1, wherein:

the insulating substrate is a refractive substrate which at least includes a first parallel portion extending in parallel with the metal plate, a second parallel portion arranged to be stacked on the other side of the first parallel portion in the thickness direction, and an intersecting portion which intersects the first and second parallel portions to connect the first and second parallel portions, the through-hole of the insulating substrate is formed in the first parallel portion, the anode is provided on a surface of the first parallel portion on the second parallel portion side, and a post having an insulating property or conductive property is interposed between the first and second parallel portions.

11. The electron multiplier according to claim 1, wherein:

the insulating substrate at least includes a first substrate and a second substrate arranged to be stacked on the other side of the first substrate in the thickness direction, the through-hole of the insulating substrate is formed in the first substrate, the anode is provided on a surface of the first substrate on the second substrate side, and a post having an insulating property or conductive property is interposed between the first and second substrates.

12. The electron multiplier according to claim 1, wherein:

the insulating substrate is a multi-substrate which at least includes a first substrate and a second substrate arranged to be stacked on the other side of the first substrate in the thickness direction, the through-hole of the insulating substrate is formed in the first substrate, and the anode is provided on the surface of the second substrate on the first substrate side.

13. The electron multiplier according to claim 12, wherein a noise shield portion is formed on a surface of the second substrate on the side opposite to the first substrate.

* * * * *